US006865807B2

(12) United States Patent
Miyamoto et al.

(10) Patent No.: US 6,865,807 B2
(45) Date of Patent: Mar. 15, 2005

(54) CYLINDER BLOCK PRODUCTION METHOD

(75) Inventors: Noritaka Miyamoto, Toyota (JP); Hirohumi Michioka, Aichi-ken (JP); Kazunari Takenaka, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 50 days.

(21) Appl. No.: 10/382,845

(22) Filed: Mar. 7, 2003

(65) Prior Publication Data

US 2003/0168197 A1 Sep. 11, 2003

(30) Foreign Application Priority Data

Mar. 8, 2002 (JP) ..... 2002-063986

(51) Int. Cl.[7] ..... B23P 11/00; F02F 1/00

(52) U.S. Cl. ..... 29/888.061; 29/888.06; 29/81.08; 29/90.7; 164/111; 164/100; 123/193.2

(58) Field of Search ..... 29/888.06, 888.061, 29/81.06, 81.08, 90.7; 164/111, 100; 123/193.2

(56) References Cited

U.S. PATENT DOCUMENTS

| | | | | |
|---|---|---|---|---|
| 5,417,607 A | | 5/1995 | Raghavan et al. | |
| 5,512,318 A | * | 4/1996 | Raghavan et al. | 427/230 |
| 5,778,713 A | * | 7/1998 | Butler et al. | 72/53 |
| 6,074,763 A | * | 6/2000 | Rueckert et al. | 428/577 |
| 2003/0079852 A1 | * | 5/2003 | Rueckert et al. | 164/100 |

FOREIGN PATENT DOCUMENTS

| | | |
|---|---|---|
| DE | 100 12 787 | 9/2001 |
| DE | 101 53 305 | 5/2003 |
| EP | 0 919 715 | 12/1998 |
| EP | 1 110 644 | 6/2001 |
| JP | 58211550 A | 12/1983 |
| JP | 3-238157 | 10/1991 |
| JP | 06278027 A | 10/1994 |
| JP | 07299390 A | 11/1995 |
| JP | 2586986 | 12/1996 |
| JP | 10-94867 | 4/1998 |

OTHER PUBLICATIONS

Official Letter issued by the German Patent and Trademark Office dated Jun. 8, 2004.

* cited by examiner

*Primary Examiner*—Marc Jimenez
(74) *Attorney, Agent, or Firm*—Finnegan, Henderson, Farabow, Garrett & Dunner, LLP

(57) ABSTRACT

A cylinder block production method is characterized by having, as a step prior to a cast-enclosing step of cast-enclosing a cast iron-made cylinder liner within a cylinder block body, an erosion-wash step of washing an outer peripheral wall surface of the cylinder liner and eroding a portion of a base structure of the cast iron forming the outer peripheral wall surface of the cylinder liner so as to form many small protrusions on the outer peripheral wall surface by jetting a high-pressure fluid onto the outer peripheral wall surface of the cylinder liner, in order to improve strength of adhesion between the cylinder liner and the cylinder block body. Since the base structure is partially eroded, complicated-shape small protrusions can be formed. Furthermore, sand and a mold release agent adhering to the outer peripheral wall surface of the cylinder liner can be removed. Therefore, the adhesion strength will improve.

5 Claims, 20 Drawing Sheets

CYLINDER BLOCK PRODUCTION METHOD

INCORPORATION BY REFERENCE

The disclosure of Japanese Patent Applications No. 2002-063986 filed on Mar. 8, 2002, including its specification, drawings and abstract, is incorporated herein by reference in its entirety.

BACKGROUND OF THE INVENTION

1. Field of the Invention

The invention relates to a production method for a cylinder block and, more particularly, to a cylinder block production method for producing a cylinder block by enclosing a cast-iron cylinder liner within a cylinder block body in a casting process.

2. Description of the Related Art

In view of fuel economy improvement through weight reduction of a cylinder block of an engine, a technology for forming a cylinder block by casting an aluminum alloy cylinder body around a cast-iron cylinder liner provided as an insert has been put into actual use.

However, a problem has been found with an engine incorporating a cylinder block formed by casting an aluminum alloy around a cast-iron cylinder liner. That is, as the engine is operated, a gap develops at an interface between the cylinder liner and the cylinder block body.

If a gap forms between the cylinder block body and the cylinder liner, the heat conductivity comes to vary in a direction of the circumference of the cylinder liner. If the heat conductivity varies in the circumferential direction relative to the cylinder liner, the thermal expansibility of the cylinder liner also varies depending on the position in the circumferential direction. As a result, the cylinder liner does not expand in a truly circular shape. If the cylinder liner forming a cylinder bore surface does not expand in a truly circular shape, the cylinder bore assumes a distorted cylinder shape, and has an increased coefficient of friction with respect to the piston that reciprocates within the cylinder bore. This results in various problems of degradation of the engine in fuel economy, performance, durability, etc., for example, increased consumption of oil, accelerated abrasion of a piston ring, and the like.

The problem of development of a gap between a cylinder liner and a cylinder block body around the cylinder liner is not limited to the case where a cylinder liner is enclosed as a cast insert within an aluminum or aluminum-alloy cylinder block body, but also occurs in cases where a cylinder liner is enclosed as a cast insert within a cylinder block of other kinds of metal. That is, this problem can occur in a case where a cylinder block is produced by casting a cast-iron cylinder block body around a cast-iron cylinder liner.

In order to prevent formation of a gap between the cylinder liner and the cylinder block body of a cylinder block formed by casting the cylinder block body around the cylinder liner, techniques have been proposed which improve the adhesion between the cylinder block body and the cylinder liner by providing asperities, protrusions, etc. on an outer peripheral surface of the cylinder liner, that is, a surface of the cylinder liner that adheres to the cylinder block body.

For example, Japanese Patent Application Laid-Open Publication No. JP-A-58-211550 discloses a "cylinder block formed by casting an aluminum alloy or the like around an outer peripheral surface of a cylinder liner of an iron-based casting, the cylinder block being characterized in that the outer peripheral surface of the cylinder liner is provided integrally with many protrusions that have a tapered shape and preferably have an inclined or curved length is buried within the cylinder block of an aluminum alloy or the like by casting" (claim 1). Regarding the protrusions, the description of an embodiment (in the left lower section of page (2) in Japanese Patent Application Laid-Open Publication No. JP-A-58-211550) states "In the embodiment, the protrusions 3 are protruded from the outer peripheral surface of the cylinder liner, and are curved in the same orientation in a circumferential direction.

It is preferable that the protrusions 3 have a protruded length that is at least about 10% of the wall thickness of the cylinder liner 2. For example, the wall thickness of the liner is 3 mm, and the protruded length of the protrusions is 0.5 mm, and a base portion of each protrusion is 1.0 mm, and a distal end portion of each protrusion is 0.2 mm. The intervals between the protrusions are greater than the size of the base portion of each protrusion, so that the fluidity will not be degraded". Also described is an example in which the protrusions are formed simultaneously with formation of the cylinder liner through the use of a mold. FIG. 30 shows a perspective view of the embodiment disclosed in Japanese Patent Application Laid-Open Publication No. JP-A-58-211550.

Considering that the wall thickness of the cast-iron cylinder liner is normally about 2 mm, the technique in which protrusions of 0.5 mm in length are provided on the external peripheral surface of the cylinder liner as in the embodiment goes against the reduction of the intervals between cylinder bores, and thus makes it difficult to provide a compact cylinder block. Furthermore, if the protruded length of the protrusions is increased to or above 0.5 mm in order to ensure the formation of the protrusions, it becomes more difficult to provide a compact cylinder block. The presence of the protrusions also incurs a danger of degrading the fluidity in the process of casting around the cylinder liner.

Japanese Patent Application Laid-Open Publication No. JP-A-3-238157 discloses a "production method for a cylinder block of an engine formed by enclosing a cast-iron cylinder liner in a cast-iron body material, the production method for the cylinder block being characterized in that an outer peripheral surface of the cylinder liner is subjected to shot peening so as to activate the surface and form many small protrusions, and then the cylinder liner is enclosed as a cast insert within the cast-iron body material" (claim 1). A similar technique in which a surface of a cylinder liner is roughened by shot blast is disclosed in Japanese Patent Application Laid-Open Publication No. JP-A-10-94867.

The techniques disclosed in Japanese Patent Application Laid-Open Publication No. JP-A-3-238157 and Japanese Patent Application Laid-Open Publication No. JP-A-10-94867 are different from the technique of forming protrusions on a surface of a cylinder liner disclosed in Japanese Patent Application Laid-Open Publication No. JP-A-58-211550, in that the outer peripheral surface of the cylinder liner is subjected to a surface roughing process by shot blast.

However, this surface roughing technique based on shot blast has been found incapable of reliably achieving a sufficient adhesion between the cylinder liner and the cylinder block body. The outer peripheral wall surface of the cylinder liner carries undesired substances deposited thereon, for example, sand (silica sand ($SiO_2$)) used as a lining on an internal surface of a mold during a cylinder molding process, and a mold release agent used on the mold.

The performance of shot blast on the outer peripheral wall surface of the cylinder liner cannot sufficiently remove the sand and the mold release agent deposited on the outer peripheral wall surface of the cylinder liner. In particular, due to the sand provided as a lining on the inner surface of the mold, asperities are formed on the outer peripheral wall surface of the cylinder liner. The sand deposited in dip portions of the rough surface of the cylinder liner cannot be removed by shot blast; moreover, sand may be pushed into dip portions by shot blast.

If the cylinder liner carrying the sand and the mold release agent deposited on the outer peripheral wall surface is enclosed as a cast insert in a cylinder block body, the sand and the mold release agent remaining on the outer peripheral wall surface of the cylinder liner are now present between the cylinder liner and the cylinder block body, so that the strength of adhesion between the cylinder liner and the cylinder block body reduces and becomes insufficient. It has been found that during operation of an engine incorporating a cylinder block in which sand and a mold release agent exist between the cylinder liner and the cylinder block body, a gap forms between the cylinder liner and the cylinder block body.

Furthermore, the shot blast performed on the outer peripheral wall surface of the cylinder liner produces pits and protrusions to a certain degree on the outer peripheral wall surface of the cylinder liner. However, the pits and protrusions do not have distinctive features, but are simple asperities. For example, the pits and protrusions formed by shot blast do not have a feature of curved distal end portions of protrusions. Therefore, the shot blast-formed pits and protrusions do not necessarily achieve sufficient improvement in the adhesion between the cylinder liner and the cylinder block body.

SUMMARY OF THE INVENTION

It is an object of the invention to provide a method of enclosing a cast iron-made cylinder liner within a cylinder block body by a casting process so as to produce a cylinder block that has an excellent strength of adhesion between the cylinder liner and the cylinder block body.

(1) A first aspect of the invention is a cylinder block production method for producing a cylinder block in which a cast iron-made cylinder liner is enclosed within a cylinder block body by casting, the method including, as a step prior to a cast-enclosing step of enclosing the cylinder liner within the cylinder block body by casting, an erosion-wash step of washing an outer peripheral wall surface of the cylinder liner and eroding a portion of a base structure of the cast iron forming the outer peripheral wall surface of the cylinder liner so as to form many small protrusions on the outer peripheral wall surface by jetting a high-pressure fluid onto the outer peripheral wall surface of the cylinder liner, in order to improve strength of adhesion between the cylinder liner and the cylinder block body.

In short, in the erosion-wash step, the base structure of the cast iron forming the cylinder liner is partially eroded by impact of a high-pressure fluid so as to form many small protrusions on the outer peripheral wall surface of the cylinder liner, and the outer peripheral wall surface is washed by the high-pressure fluid. The cylinder liner whose outer peripheral wall surface has small protrusions and has been washed is cast-enclosed in the cast-enclosing step. Therefore, the cylinder block production method of the invention is able to produce a cylinder block having an excellent strength of adhesion between the cylinder liner and the cylinder block body.

(2) In the erosion-wash step of the cylinder block production method of the first aspect of the invention, the base structure of the cast iron forming the outer peripheral wall surface of the cylinder liner is partially eroded by jetting the high-pressure fluid onto the outer peripheral wall surface of the cylinder liner. When the base structure is partially eroded by impact of the high-pressure fluid, cracks form at low-strength sites in the cast iron, and near-crack portions of the base structure fall off.

Cast iron has portions of graphite and portions of the base structure surrounding the graphite portions. Normally, boundaries between the base structure and the graphite have low strength, and are likely to have cracks. Therefore, when cracks form in cast iron due to impact of the high-pressure fluid, cracks form along boundaries between the base structure and the graphite, or cracks form inside the graphite. For example, if graphite portions are three-dimensionally linked as in flake graphite cast iron, cracks grow along boundaries between graphite portions and the base structure, so that crack-adjacent portions of the base structure fall off.

Graphite portions are dispersed in the base structure. Therefore, if many small protrusions are formed on the outer peripheral wall surface by partial erosion of the base structure upon impact of the high-pressure fluid, the small protrusions include complicated-shape small protrusions, for example, curved small protrusions, or small protrusions whose distal ends face the outer peripheral wall surface.

Therefore, the cast-enclosure of the cylinder liner whose outer peripheral wall surface has many small protrusions, including complicated-shape small protrusions, will produce a cylinder block that is superior in adhesion strength to a cylinder block produced by cast-enclosing a cylinder liner whose outer peripheral wall surface has simple asperities, for example, asperities formed by shot blast.

Furthermore, since the base structure of the cast iron forming the outer peripheral wall surface is partially eroded by the high-pressure fluid in the erosion-wash step, the sand and the mold release agent deposited on the outer peripheral wall surface of the cylinder liner during its casting process can be sufficiently removed. As portions of the base structure are eroded by the jetted high-pressure fluid, the sand and the mold release agent adhering to the falling-off portions of the base structure are removed. Furthermore, the high-pressure fluid washes off the sand and the mold release agent from the outer peripheral wall surface. Thus, the outer peripheral wall surface of the cylinder liner subjected to the erosion-wash step is sufficiently free from sand and the mold release agent. Therefore, the casting of the cylinder block body around the cylinder liner in the cast-enclosing step avoids an event that sand and the mold release agent remain at boundaries between the cylinder liner and the cylinder block body. As a result, the strength of adhesion between the cylinder liner and the cylinder block body will improve.

The high-pressure fluid used may be water or a preservative-containing water. The fluid is not limited to water, but may also be oil or the like. That is, any liquid suitable to be jetted in a high-pressure fluid state can be selected and used. In view of washing the outer peripheral wall surface of the cylinder liner, the use of water is preferable.

(3) If small protrusions are formed on the outer peripheral wall surface by eroding portions of the base structure in the erosion-wash step, the small protrusions may include small protrusions that have a complicated shape as mentioned above. In this case, it is possible to form a key-shaped small protrusion that has a surface having an angle less than 90 degrees with respect to the outer peripheral wall surface. It is also possible to form a key-shaped small protrusion which has an angle less than 90 degrees with respect to the outer peripheral wall surface and has a distal end that is curved toward the outer peripheral wall surface.

The "outer peripheral wall surface" in the phrase of "90 degrees with respect to the outer peripheral wall surface" means an ideal smooth surface that serves as a reference for forming an actual outer peripheral wall surface.

If complicated-shape small protrusions, including the aforementioned key-shaped small protrusions, are formed on the outer peripheral wall surface of the cylinder liner, the cylinder block produced by cast-enclosing the cylinder liner within the cylinder block body will have an improved strength of adhesion between the cylinder liner and the cylinder block body.

(4) In the cylinder block production method of the first aspect of the invention, the base structure of the cast iron forming the cylinder liner is partially eroded by jetting the high-pressure fluid, such as high-pressure water or the like, to the outer peripheral wall surface of the cylinder liner. It is preferable that a jet of the high-pressure fluid be a fan jet.

In the method, the jetting of the high-pressure fluid, such as high-pressure water or the like, is normally performed by using a nozzle. The width and shape of the footprint of the high-pressure fluid vary depending on the kinds of nozzles. For example, variations in the shape of the nozzle and, in particular, the shape of the high-pressure fluid outlet of the nozzle, allow the high-pressure fluid to be jetted in such a fashion that the high-pressure fluid concentrates at a point or into a small area on an object, or allow the high-pressure fluid to be jetted in such a fashion that the high-pressure spreads to a certain area on an object.

In the cylinder block production method of the first aspect of the invention, it is preferable that the high-pressure fluid be jetted to the outer peripheral wall surface of the cylinder liner in such a manner as to spread to a certain area on the object. By jetting the high-pressure fluid so as to spread to a certain area on an object, many small protrusions can be reliably and uniformly formed over the outer peripheral wall surface of the cylinder liner.

The jetting of the high-pressure fluid so as to spread to a certain area on an object can be accomplished by fan-jetting the high-pressure fluid. Therefore, it is preferable that the jet of the high-pressure fluid be a fan jet. The fan jet herein means jetting the high-pressure fluid from the nozzle in a spread-and-atomized fashion.

(5) In the cylinder block production method of the first aspect of the invention, the base structure of the cast iron forming the outer peripheral wall surface of the cylinder liner can be partially eroded by the impact of the high-pressure fluid jetted onto the outer peripheral wall surface. Therefore, it is preferable to select and use a cast iron that allows easy erosion of portions of the base structure thereof upon impact of the high-pressure fluid.

For example, since cracks are formed along boundaries between the graphite and the base structure or inside the graphite so that the base structure is partially eroded and small protrusions are formed, it is preferable to use a cylinder liner produced from a cast iron that facilitates formation of cracks along the graphite and the base structure upon impact, or a cast iron that facilitates formation of cracks inside the graphite upon impact.

Preferable examples of such a cast iron include a flake graphite cast iron in which the graphite is formed of an ordinary A-type graphite, a flake graphite cast iron in which a near-surface portion has a structure of pearlite and a D-type graphite (super-cooled graphite) formed by rapid cooling during the casting of a flake graphite cast iron, a gray cast iron partially containing a chill structure, a vermicular graphite cast iron, etc.

Explanation will be made, taking the flake graphite cast iron as an example. In a flat section of the flake graphite cast iron, the graphite has a flake shape. Most flake-shaped graphite portions are contiguously linked complicatedly in a three-dimensional fashion. If the flake graphite cast iron receives impact, cracks are likely to form at boundaries between the contiguously linked graphite portions and the base structure. Therefore, if the outer peripheral wall surface of a cylinder liner formed from such a flake graphite cast iron is subjected to jets of a high-pressure fluid, cracks form along boundaries between the base structure and contiguously linked graphite portions, so that the base structure will partially fall off. In the case of flake graphite cast iron, graphite portions are contiguously linked in a complicated fashion. Therefore, cracks also form inside the graphite, and the base structure partially falls off via cracked portions.

(6) Thus, the cylinder block produced by the cylinder block production method of the first aspect of the invention has an improved strength of adhesion between the cylinder liner and the cylinder block body. Therefore, if this cylinder block is used as a component member of an engine, it is possible to substantially avoid an event that gaps form between the cylinder liner and the cylinder block body.

As a result, variation of heat conductivity in a circumferential direction of a cylinder liner can be avoided, and a perfectly circular shape of a cylinder bore in a section perpendicular to the axis of the cylinder bore can be maintained.

(7) If a cylinder block body of one metal is cast around a cylinder liner of another metal, it is conventionally difficult to increase the strength of adhesion between the cylinder liner and the cylinder block body for reasons of, for example, poor attachment or affinity of the molten metal for the cylinder block body to the cylinder liner. However, the employment of the cylinder block production method of the first aspect of the invention allows production of a cylinder block having excellent adhesion strength even if the cylinder block is formed by cast-enclosing a cast iron-made cylinder liner within a cylinder block body made of aluminum or an aluminum alloy.

Therefore, weight reduction of a cylinder block can be achieved by using aluminum or an aluminum alloy as a material of the cylinder block body. Furthermore, since it becomes possible to maintain a good circularity of cylinder bores of a cylinder block made up of a cast iron-made cylinder liner and an aluminum alloy-made cylinder block body, the fuel economy of an engine can be improved.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF PREFERRED EMBODIMENTS (1) Embodiments of the invention will be described below. A cylinder block production method of the invention is a cylinder block production method for producing a cylinder block in which a cylinder liner of a cast iron is enclosed within a cylinder block body by casting, the method including an erosion-wash step and a cast-enclosing step.

(2) A cylinder block production method of the invention includes a cast-enclosing step of enclosing a cylinder liner with a cylinder block body by casting after the erosion-wash step.

The cast-enclosing step can be carried out by a known method. That is, a cylinder liner that has been subjected to the erosion-wash step is set in a cavity of a die, and then the cylinder liner is enclosed by pouring a metal melt that forms the cylinder block into the mold in a die-cast technique or the like.

The metal used to form the cylinder block is any metal that can be used for a cylinder block body. Examples of the metal include cast iron, aluminum, aluminum alloys, magnesium alloys, etc. As for the cast iron used for the cylinder liner, it is possible to cast-enclose the cylinder liner with a different metal, and it is also possible to cast-enclose the cast-iron cylinder liner with a cast iron.

(3) A cylinder block production method of the invention includes an erosion-wash step of forming many small protrusions on an outer peripheral wall surface of the cylinder liner by jetting a high-pressure fluid, such as high-pressure water or the like, to the outer peripheral wall surface of the cylinder liner so as to partially erode a base structure of a cast iron that forms the outer peripheral wall surface of the cylinder liner, and of washing the outer peripheral wall surface of the cylinder liner.

Figure 1:
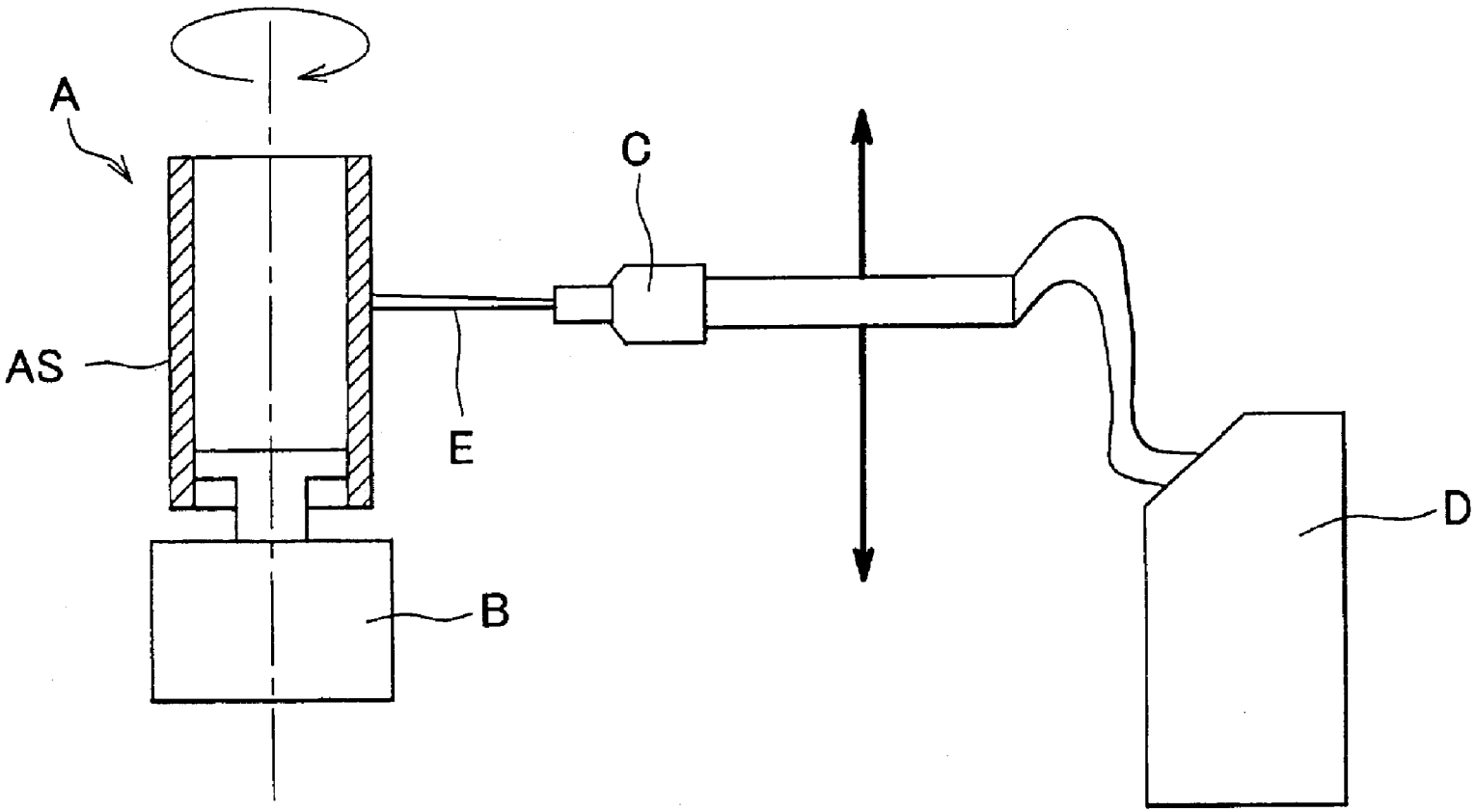
FIG. 1 is a schematic diagram illustrating an embodiment of the erosion-wash step in the cylinder block production method of the invention.

The erosion-wash step can be carried out by, for example, an embodiment described below. FIG. 1 schematically illustrates an embodiment of the erosion-wash step. In this embodiment, water is used as a high-pressure fluid. However, the high-pressure fluid used is not limited to water, but may also be a preservative-containing water, or other kinds of fluids, for example, an oil or the like.

A cylinder liner A formed by using a mold or the like is fixed to a chuck B. The chuck B has been set so that the cylinder liner A fixed to the chuck B can be rotated about an axis of the cylinder liner A.

While the cylinder liner A is rotated, high-pressure water is jetted to the outer peripheral wall surface of the cylinder liner A from a nozzle C via a high-pressure pump D. The jetted high-pressure water impacts the outer peripheral wall surface AS of the cylinder liner A, thereby removing portions of the base structure of the cast iron that forms the outer peripheral wall surface AS of the cylinder liner A. As a result, many small protrusions are formed on the outer peripheral wall surface AS of the cylinder liner A, and simultaneously the outer peripheral wall surface AS of the cylinder liner A is washed.

The small protrusions are formed by high-pressure water eroding portions of the base structure of the cast iron. Therefore, it is possible to form key-shaped small protrusions having a surface that extends at an angle less than 90 degrees with respect to the outer peripheral wall surface AS of the cylinder liner A. Furthermore, it is possible to form key-shaped small protrusions whose distal ends are curved toward the outer peripheral wall surface AS of the cylinder liner A.

The jetting of high-pressure water can be performed at a pressure, a flow rate, etc. that are suitable to erode portions of the base structure that form the outer peripheral wall surface of the cylinder liner.

(4) It is preferable that the jetting of high-pressure water be performed by fan-jet. The fan-jet makes it possible to strike a certain area of the outer peripheral wall surface of the cylinder liner with high-pressure water at a time. As a result, it becomes possible to uniformly strike the entire area of the outer peripheral wall surface with high-pressure water by moving the nozzle C so as to shift the area that high-pressure water strikes at a time. Therefore, portions of the base structure can be eroded uniformly over the entire area of the outer peripheral wall surface of the cylinder liner.

The nozzle used for fan-jetting high-pressure water may be a fan-jet nozzle disclosed in Japanese Patent Application Laid-Open Publication No. JP-A-6-278027 (titled "Hard Coating Removing Method by Ultra-high Pressure Fan-jet Nozzle, and applied by Flow International Corporation), or a fan-jet nozzle disclosed in Japanese Patent Application Laid-Open Publication No. JP-A-7-299390 (titled "Ultra-high Pressure Fan-jet Nozzle", and applied by Flow International Corporation).

Figure 2:
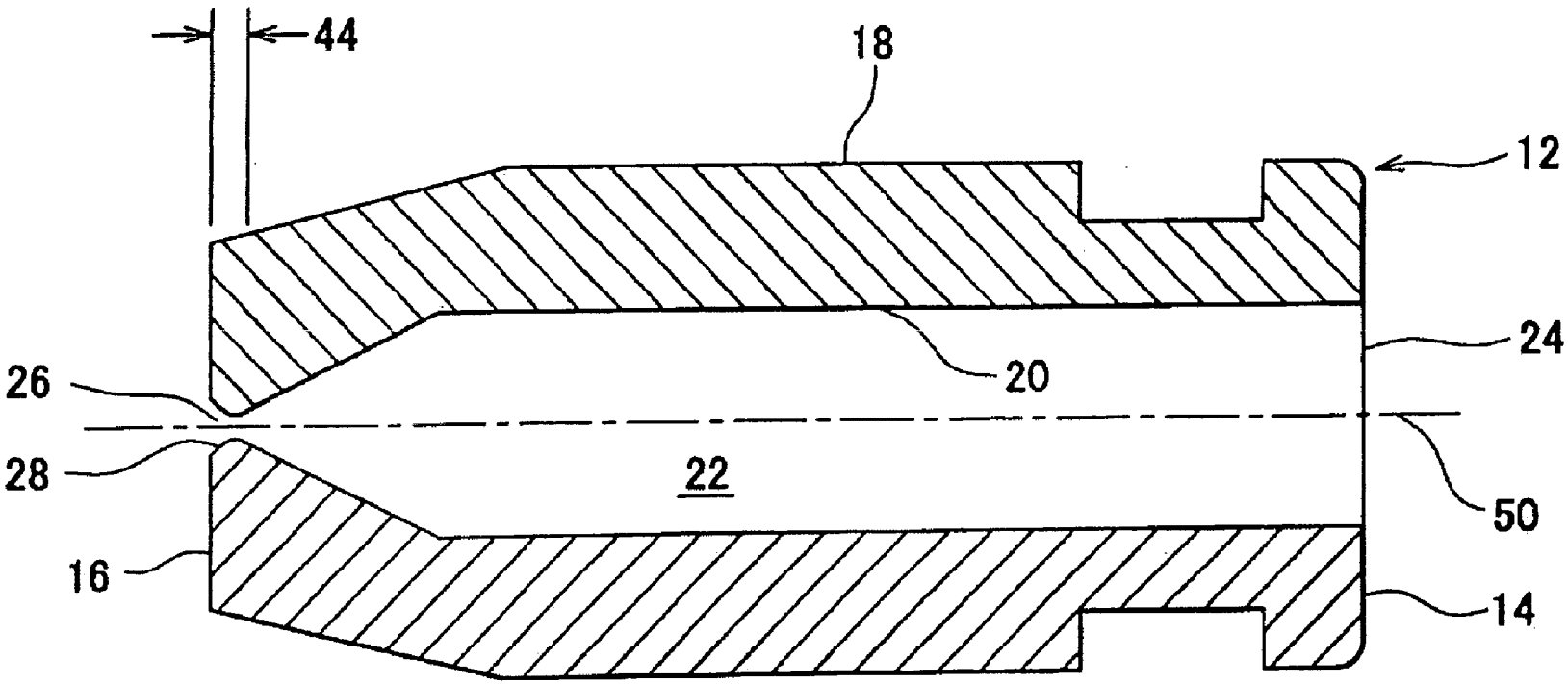
FIG. 2 PRIOR ART
FIG. 2 is a section of a nozzle along an axis thereof disclosed as an embodiment in Japanese Patent Application Laid-Open Publication No. JP-A-7-299390.

Japanese Patent Application Laid-Open Publication No. JP-A-7-299390 describes, as a preferred embodiment, a fan-jet nozzle shown in FIGS. 2 and 3, as follows. This "nozzle 12 has a first end portion 14, a second end portion 16, an outer surface 18, and an inner surface 20. The inner surface 20 is defined by a conical bore 22 that extends from the first end portion 14 to the second end portion 16. The conical bore 22 has an inlet orifice 24 and an outlet orifice 26 that are formed in the first end portion 14 and the second end portion 16, respectively. A wedge-shaped notch 28 extends from the second end portion 16 in a direction toward the first end portion 14 to a depth 44 where the wedge-shaped notch 28 intersects with the conical bore 22. Therefore, the shape of the outlet orifice 26 is formed by the intersection between the conical bore 22 and the wedge-shaped notch 28. As a certain volume of pressurized fluid moves out of the outlet orifice 26 through the nozzle 12, the pressurized fluid is ejected from the nozzle 12 as a fan-jet that has a substantially linear footprint due to the shape of the outlet orifice 26" ((0009) in section 6 of page (4) in the patent application).

Figure 3:
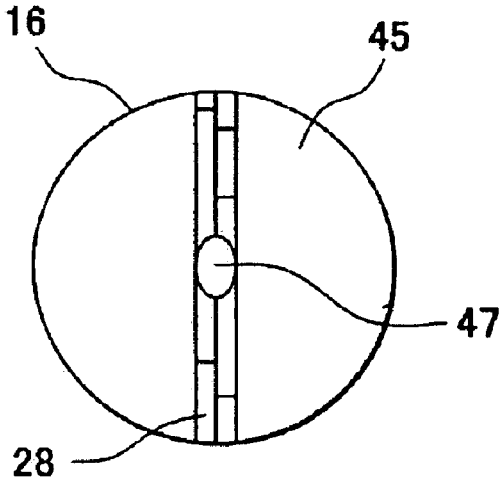
FIG. 3 PRIOR ART
FIG. 3 is a front view of a high-pressure water outlet of a nozzle disclosed as an embodiment in Japanese Patent Application Laid-Open Publication No. JP-A-7-299390.

As shown in FIG. 3, the outer surface 18 of the nozzle 12 has "a conical shape such that the second end portion 16 has a substantially circular flat surface 45. The wedge-shaped notch 28 is aligned with a diameter of the circular surface 45 so that the notch 28 extends through a center 47 of the second end portion 16. As a result, a fan-jet of pressurized fluid moves out of the nozzle 12 in a direction that substantially aligns with a lengthwise axis 50 of the nozzle 122" ((0010) in section 6 of page (4) in the patent application).

Figure 4:
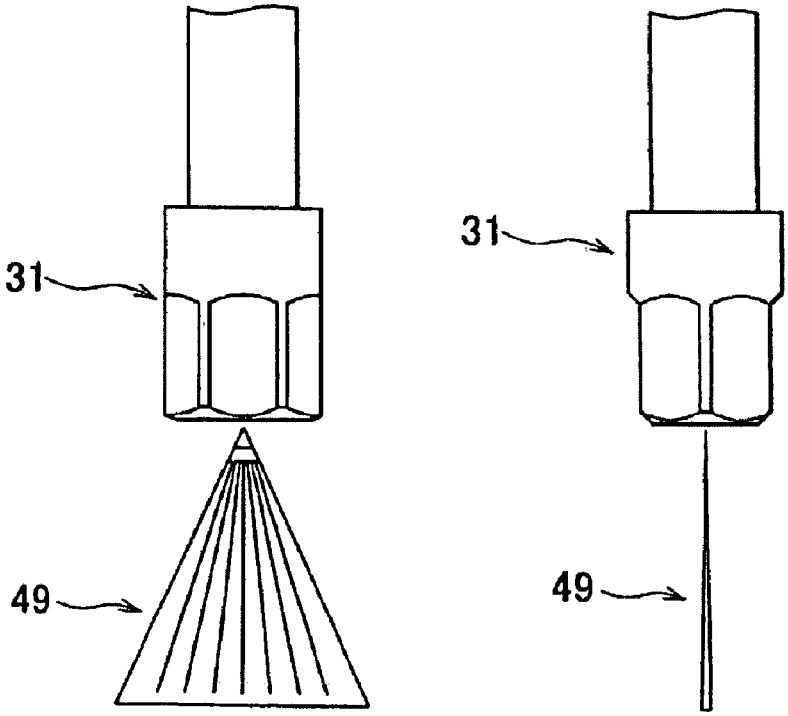
FIG. 4 PRIOR ART
FIG. 4 shows front and side views of a nozzle disclosed as an embodiment in Japanese Patent Application Laid-Open Publication No. JP-A-7-299390, indicating the shape of a footprint of high-pressure water jetted from the nozzle.

Due to this construction of the nozzle, the fan jet from the nozzle, as shown in FIG. 4, "can be referred to as "straight" fan 49. The straight fan 49 is effective in various cases, for example, in washing, removal of a coating, etc., as described in detail below" ((0010) in section 6 of page (4) in the patent application). FIG. 4 shows a front view and a side view of the fan-jet nozzle and the shape of a footprint of high-pressure water jetted from the nozzle.

Then, the "pressurized fluid ejected from the nozzle 12 has a shape of fan-jet having a substantially linear footprint. The width of fan-jet varies in accordance with variations of the geometrical configuration of the nozzle 12. For the purpose of description, the footprint can be considered to have a thin rectangular shape or an elliptical shape having a very high aspect ratio (long axis to short axis), for example, 100 to 1. The geometrical shape of the fan-jet can be controlled by adjusting the geometrical shape of the nozzle. It is preferable that the geometrical shape of the fan-jet be one of various geometrical shapes based on the work at hand. For example, what is often desired in the case of washing is to selectively remove an extraneous matter layer from a lower surface without damaging the lower surface. Furthermore, it is desired and is often necessary to provide a 100%-washed surface. The extraneous matter layer can be removed uniformly and thoroughly by sweeping a fan-jet formed by a preferred embodiment of the nozzle 12 shown in the drawings across the surface to be washed, in a direction of the short axis of the footprint of fan-jet. Therefore, problems associated with rotation and translational motion of the circular jet can be avoided. As can be understood by those skilled in the art, it is possible to wash a larger area rapidly and efficiently by aligning and translationally moving many nozzles 12 in concert across the surface" ((0011) in section 7 of page 5 in the patent application).

The high-pressure water jetted from the nozzle becomes atomized at a certain distance from the outlet orifice. Therefore, the footprint of high-pressure water expands to a certain area having an elliptical shape.

In the erosion-wash step of a cylinder block production method of the invention, high-pressure water can be fan-jetted by using a fan-jet nozzle as described above as the nozzle C shown in FIG. 1. In this case, the cylinder liner A fixed to the chuck B is rotated about the axis of the cylinder liner A. Furthermore, the nozzle C is set so that the direction of the long axis of the footprint of the high-pressure water E fan-jetted from the nozzle C coincides with a direction perpendicular to the axis of the cylinder liner A shown in FIG. 1, and therefore the direction of the short axis of the footprint of the high-pressure water E coincides with a direction of the axis of the cylinder liner A.

Then, the nozzle C is moved at an appropriate speed in the direction of the axis of the cylinder liner A while high-pressure water E is being fan-jetted from the nozzle C to the outer peripheral wall surface of the rotating cylinder liner A. By moving the nozzle C so that high-pressure water E fan-jetted from the nozzle C strikes the outer peripheral wall surface AS of the cylinder liner A from an upper end to a lower end of the surface, the fan-jetted high-pressure water E can substantially uniformly strike the entire area of the outer peripheral wall surface AS of the cylinder liner A.

In the case where high-pressure water is fan-jetted against the outer peripheral wall surface of the cylinder liner by using the fan-jet nozzle as described above, the nozzle diameter, that is, the diameter of the water jet outlet, as well as the pressure of high-pressure water, the amount of flow of high-pressure water, etc. can be set in such ranges as to allow removal of portions of the base structure of the cast iron that forms the outer peripheral wall surface of the cylinder liner.

The nozzle diameter may be about 0.25 to 0.56 mm, and preferably, 0.3 to 0.45 mm. Since a certain amount of flow is needed, the nozzle diameter needs to be a certain size. However, if the nozzle diameter is excessively great, it becomes necessary to provide a large-capacity facility. The water pressure of high-pressure water may be about 207 MPa or higher, and preferably, 276 to 414 MPa. In order to erode portions of the cast iron, the pressure of high-pressure water needs to be at least 207 MPa. However, considering efficiency, a preferable pressure of high-pressure water is 276 to 414 MPa.

The flow rate of high-pressure water may be about 2 to 20 L/min. and preferably 2.67 to 10 L/min. The throughput capacity is given by pressure×flow rate. The flow rate is determined by the relationship with pressure.

In a case where high-pressure water is fan-jetted in the aforementioned conditions, the distance from the high-pressure water outlet of the nozzle to the outer peripheral wall surface of the cylinder liner may be about 5 to 40 nm, and preferably 10 to 25 mm. In designing a nozzle, the distance from the high-pressure water outlet of the nozzle to the outer peripheral wall surface of the cylinder liner can be freely set. However, considering the distance that is needed for the water to become atomized as well as pressure attenuation, the aforementioned distance is generally appropriate.

Furthermore, the moving speed of the nozzle in the direction of the axis may be about 1 to 20 mm/sec., and preferably 2 to 8 mm/sec. If the capacity of the high-pressure pump allows, a greater moving speed of the nozzle is more preferable in view of efficiency and rust prevention. However, considering the capacity of existing pumps, the aforementioned level of moving speed of the nozzle is generally preferable.

The rotation speed of the cylinder liner having an outer diameter of about 80 mm may be about 50 to 1000 rotations/minute (rpm), and preferably 100 to 600 rpm. If the rotation speed of the cylinder liner is excessively low, nonuniformity results. If the rotation speed of the cylinder liner is excessively high, the vector of water stream that perpendicularly strikes the workpiece (cylinder liner) becomes inconveniently small.

The erosion-wash step based on high-pressure water jet performed in examples described below was performed in accordance with embodiments employing the above-described fan-jet nozzle.

(5) The cast iron normally has base structure portions and graphite portions. If an impact is given to such a cast iron, cracks normally form at low-strength sites, so that the base structure may fall off from the cracked sites. In the case of cast iron, boundary portions between the base structure and the graphite are generally considered low-strength portions, and graphite interiors are generally considered low-strength portions.

Therefore in the invention, it is preferable to use a cast iron in which graphite is distributed so that cracks formed in low-strength portions become linked in a complicated fashion, in view of formation of many small protrusions by removing portions of the base structure. Hence, it is preferable to select and use a cast iron in which graphite portions are three-dimensionally linked or graphite portions are close to each other so that the cracks formed in boundaries between graphite and the base structure or the cracks formed inside graphite portions are likely to link. Such a cast iron can be said to be a cast iron in which, upon an impact, cracks link to one another and portions of the base structure fall off so that small protrusions of complicated shapes will likely form.

Preferable examples of the cast iron include a flake graphite cast iron in which the graphite is an ordinary A-type graphite, and a flake graphite cast iron in which a D-type graphite exists near surfaces due to the rapid cooling of near-surface portions. If a cast iron is rapidly cooled, a chill structure may form. A cast iron having a structure in which a chill structure is present partially but is not formed entirely therein may also be adopted. It is also possible to adopt a "worm-like graphite cast iron" generally termed vermicular cast iron.

Therefore, in the cylinder block production method of the invention, it is preferable to use a cylinder liner formed by casting a cast iron mentioned above.

Figure 5:
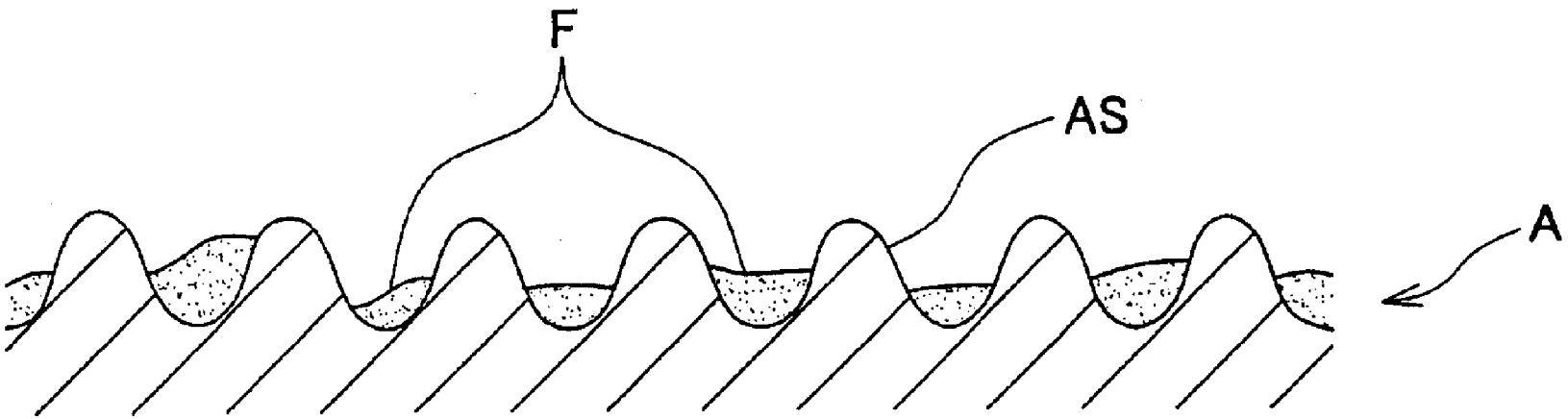
FIG. 5 is a schematic diagram illustrating a state of the outer peripheral wall surface of a cylinder liner cast by using a mold having a sand-lined inner surface.
Figure 6:
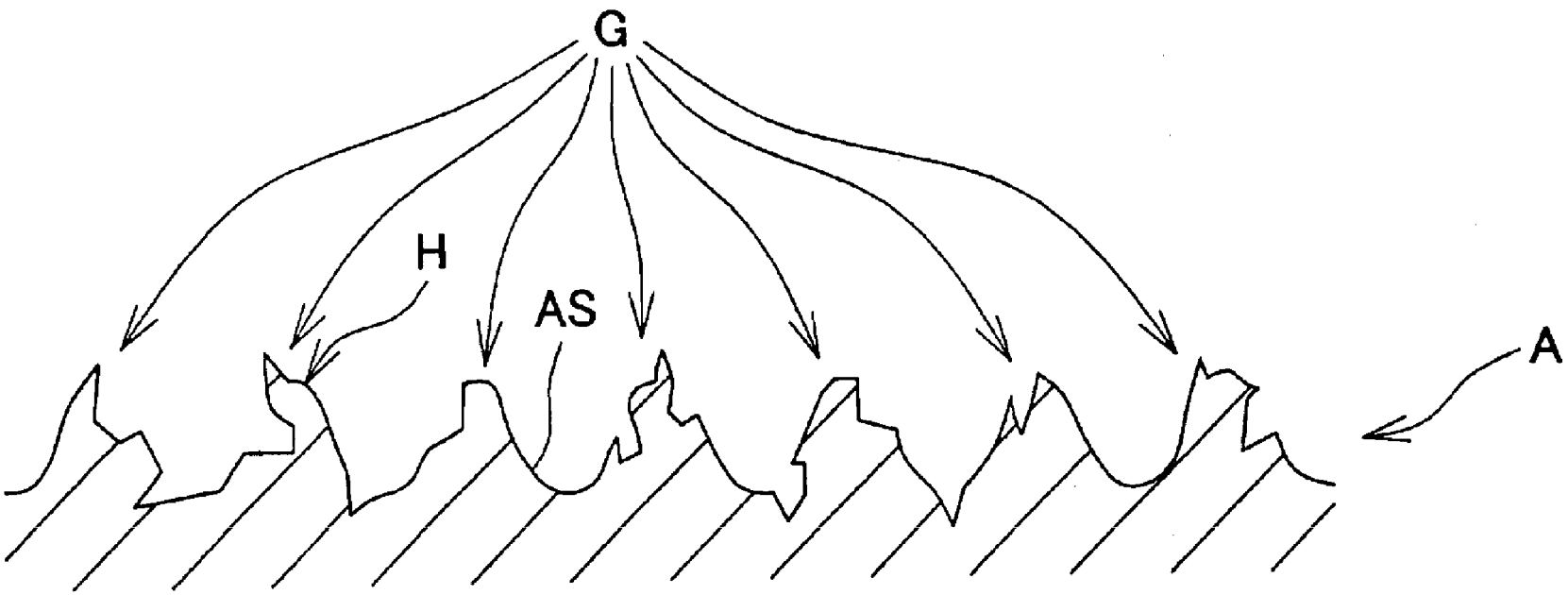
FIG. 6 is a schematic diagram illustrating a state of the cylinder liner where portions of a base structure of cast iron forming the outer peripheral wall surface of the cylinder liner have been removed by executing an erosion-wash step.

(6) FIG. 5 schematically illustrates a state of the outer peripheral wall surface AS of the cylinder liner A occurring when the cylinder liner is cast by using a mold having a sand-lined inner surface. That is, FIG. 5 shows a state of the outer peripheral wall surface AS of the cylinder liner A at a stage prior to execution of the erosion-wash step. FIG. 6 schematically illustrates a state of the outer peripheral wall surface AS of the cylinder liner A occurring when portions of the base structure of cast iron forming the outer peripheral wall surface AS of the cylinder liner A have been eroded by executing the erosion-wash step. In FIGS. 5 and 6, the cylinder liner and the outer peripheral wall surface of the cylinder liner are represented by the same reference characters as in FIG. 1.

Cast-iron cylinder liners are often cast through the use of a die having a sand-lined cavity surface. The sand lining is provided for the purpose of preventing thermal destruction of the die used for casting a cast iron, and of forming asperities on the outer peripheral wall surface of the cylinder liner due to the lining sand. Therefore, as shown in FIG. 5, asperities are formed on the outer peripheral wall surface AS of the cylinder liner A, and sand and the mold release agent F remain in dip portions of the outer peripheral wall surface AS.

If such a cylinder liner A is cast-enclosed with a cylinder block body, the sand and the mold release agent F become a cause for impaired adhesion between the cylinder liner and the cylinder block body.

In the related art, it is a normal practice to perform shot blast on a cylinder liner A before casting a cylinder block body around the cylinder liner A. However, although the shot blast process may further produce asperities, the shot blast process cannot remove the sand and the mold release agent F deposited on the outer peripheral wall surface AS of the cylinder liner A. Moreover, the shot blast process sometimes may break small protrusions formed on the outer peripheral wall surface AS.

In contrast, in the erosion-wash step in the invention, a high-pressure fluid, such as high-pressure water or the like, is jetted against the outer peripheral wall surface AS of the cylinder liner A so as to erode portions of the base structure of cast iron forming the outer peripheral wall surface AS of the cylinder liner A, so that many small protrusions G are formed on the outer peripheral wall surface AS, as shown in FIG. 6. As small protrusions G formed due to the fall-off of portions of the base structure, it is also possible to form key-shaped small protrusions H having a surface that extends at an angle less than 90 degrees with respect to the outer peripheral wall surface AS.

Furthermore, simultaneously with the erosion of portions of the base structure, the jet of high-pressure water removes the sand and the mold release agent F deposited on the outer peripheral wall surface AS, thus washing the outer peripheral wall surface. That is, when portions of the base structure are eroded by high-pressure water jet, the sand and the mold release agent F deposited on the outer peripheral wall surface AS of the cylinder liner A formed by casting as indicated in FIG. 5 are washed off together with the portions of the base structure eroded by high-pressure water. Therefore, the sand and the mold release agent F can be removed from the outer peripheral wall surface AS of the cylinder liner A as indicated in FIG. 6.

Figure 7A:
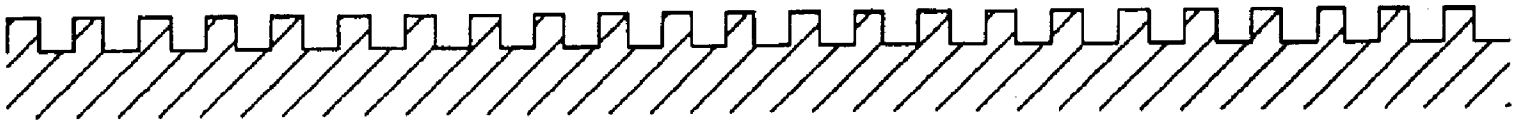
FIGS. 7A and 7B illustrate different configurations of asperities of the outer peripheral wall surfaces of cylinder liners.
Figure 7B:
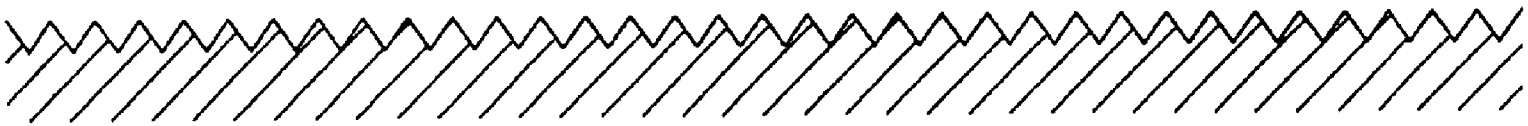

The outer peripheral wall surface of the cylinder liner to which the erosion-wash step carried out by high-pressure water jet in accordance with the invention is applied is not limited to an outer peripheral wall surface having asperities as shown in FIG. 5. The erosion-wash step can also be performed on a surface smoothed by machining. The erosion-wash step can also be performed on an outer peripheral wall surface having rectangular pits and protrusions as shown in FIG. 7(A), and an outer peripheral wall surface having serrate pits and protrusions as shown in FIG. 7(B).

The erosion-wash step erodes portions of the base structure of cast iron that forms the outer peripheral wall surface of the cylinder liner through the use of a high-pressure fluid. Therefore, the erosion-wash step can be performed on the outer peripheral wall surface of a cylinder liner as long as portions of the base structure of cast iron can be eroded by the high-pressure fluid, regardless of the presence/absence of pits and protrusions on the outer peripheral wall surface prior to execution of the erosion-wash step, the shape of pits and protrusions, etc.

EXAMPLES

[1] Production of Cylinder Block

Examples of the cylinder block production method of the invention will be described below.

(1) In Example 1 of the cylinder block production method of the invention, a cylinder block as described below was produced.

A tubular cylinder liner of flake graphite cast iron (JIS 5501 F230 (hereinafter, simply referred to as "FC230") having an inside diameter of 79 mm, an outside diameter of 89 mm and a length of 136 mm was produced by centrifugal casting. Since the flake graphite cast iron was subjected to centrifugal casting, a near-surface portion of the outer peripheral wall surface of the cylinder liner was formed by a flake graphite cast iron having a D-type graphite, and an internal portion of the cylinder liner was formed by a flake graphite cast iron having an A-type graphite.

The cylinder liner was cast through the use of a die having a sand-lined inner surface. Therefore, at the stage where the cylinder liner was cast, die-lining sand (silica sand $SiO_2$) and the mold release agent were stuck on the outer peripheral wall surface of the cylinder liner. The lining of the die with sand was provided in order to prevent destruction of the die due to heat from the molten metal and to form small asperities on the outer peripheral wall surface of the cylinder liner due to the lining sand.

Considering that a cast cylinder liner is normally subjected to a shot blast process so as to remove the sand and the mold release agent adhered to the outer peripheral wall surface of the cylinder liner in the related art, shot blast was also performed on the outer peripheral wall surface of the cylinder liner formed by centrifugal casting in this example. In this example, the shot blast was performed prior to the erosion-wash step executed by high-pressure water jet in association with a comparative example of production of a cylinder block as described below. However, the cast cylinder liner may be immediately subjected to the erosion-wash step executed by high-pressure water jet, without execution of the shot blast process.

The shot blast was performed by using alumina particles (#24) as a grid in the condition that the amount of grid projection was 135 g/min., and the grid speed was 60 m/sec., and the processing time was 0.07 sec./$cm^2$. As a result, asperities were formed to a certain degree on the outer peripheral wall surface of the cylinder liner, with dip portions of the asperities substantially filled with residual sand.

The cylinder liner subjected to shot blast was then subjected to the erosion-wash step of the embodiment described above. The erosion-wash step in this example will be described with reference to FIG. 1, which is referred to above in conjunction with description of the embodiment. Components and elements similar to those shown in FIG. 1 will be represented by the reference characters used in FIG. 1.

First, the cylinder liner A was fixed to a chuck B so that the cylinder liner A was rotatable about an axis of the cylinder liner A.

Then, while the cylinder liner A was rotated at a rotation speed of 650 rpm via the cylinder liner A, high-pressure water was jetted from the nozzle C to the outer peripheral wall surface AS of the cylinder liner A. The pressure of high-pressure water was 380 MPa. The flow rate of high-pressure water was 4.16 L/min. The nozzle diameter of the nozzle C used was 0.38 mm. The moving speed of the nozzle C was set at 2 mm/min. The nozzle C used was a fan-jet nozzle that caused atomization of high-pressure water at a distance of 10 mm from the high-pressure water outlet (outlet orifice). The distance from the outlet of the nozzle C to the outer peripheral wall surface of the cylinder liner was set at 12.5 mm.

In the aforementioned conditions, the outer peripheral wall surface AS of the cylinder liner A was subjected to the erosion-wash step performed by high-pressure water jet, thereby eroding portions of the base structure of the outer peripheral wall surface AS of the cylinder liner.

After the erosion-wash step, the cylinder liner was subjected to a cast-enclosing step, thereby producing a cylinder block. In this cast-enclosing step, the cylinder liner was cast-enclosed by a die-casting process using an aluminum alloy (JIS H ADC 12 (hereinafter, simply referred to as "ADC 12")) for a cylinder block body.

As Comparative Example 1 for a comparison purpose, a cylinder liner at a stage immediately following the shot blast process, that is, a cylinder liner not subjected to the erosion-wash step performed by high-pressure water jet, was subjected to the same cast-enclosing step as in Example 1, so that a cylinder block was produced by casting the aluminum alloy (ADC 12) around the cylinder liner.

Figure 8:
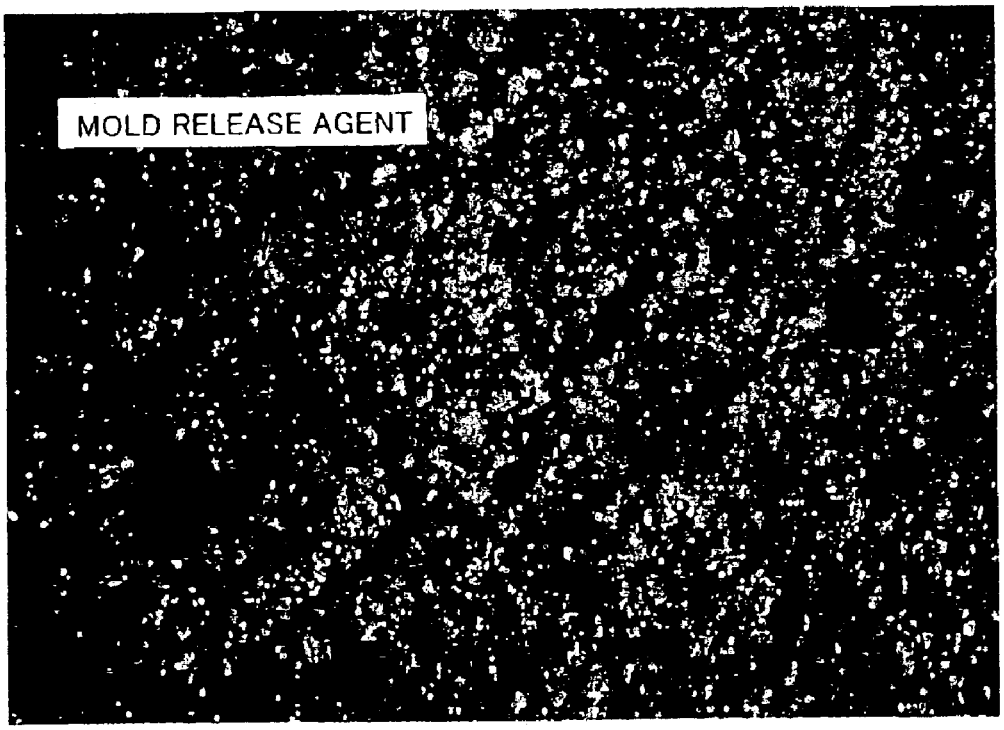
FIG. 8 shows a magnified photograph of the outer peripheral wall surface of a cylinder liner of Comparative Example 1 subjected to a shot blast process but not subjected to the erosion-wash step by high-pressure water jet.
Figure 9:
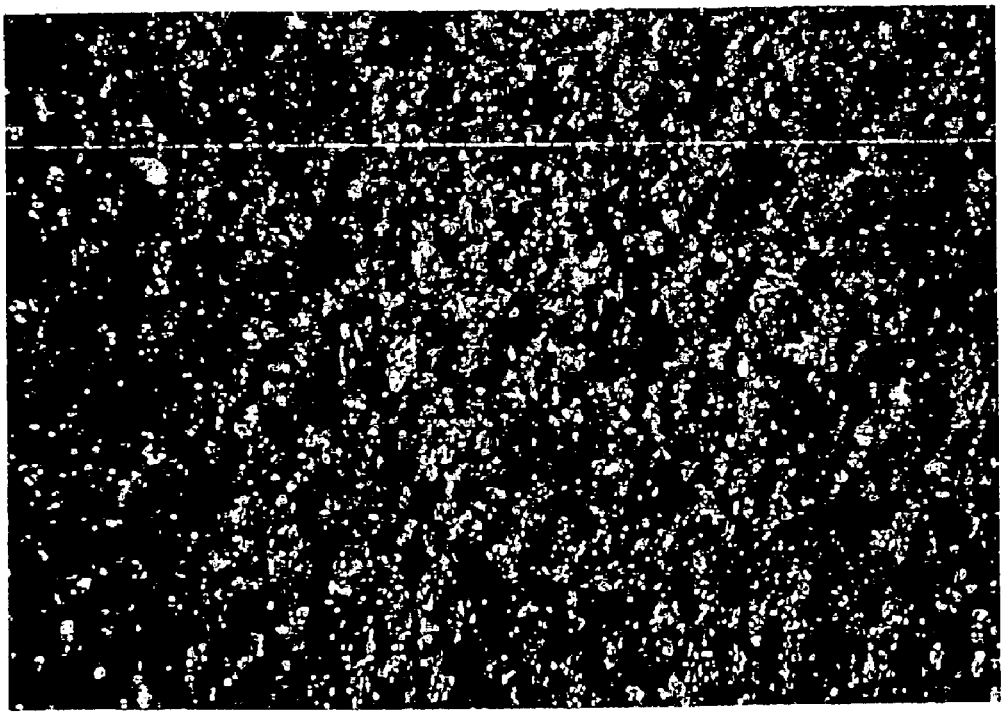
FIG. 9 shows a magnified photograph of the outer peripheral wall surface of a cylinder liner of Example 1 subjected to the shot blast process and the erosion-wash step performed by high-pressure water jet.

FIG. 8 shows a magnified photograph of the outer peripheral wall surface of the cylinder liner of Comparative Example 1, which was subjected to the shot blast process, but was not subjected to the erosion-wash step executed by high-pressure water. FIG. 9 shows a magnified photograph of the outer peripheral wall surface of the cylinder liner of Example 1, which was subjected to the erosion-wash step. Comparison between the FIG. 8 and FIG. 9 tells that the outer peripheral wall surface shown in FIG. 9 has more evident asperities than the outer peripheral wall surface shown in FIG. 8. Furthermore, in FIG. 8, adhesion of the mold release agent can be seen.

Each of FIGS. 10, 11, 12 and 13 shows a photograph of a section of a boundary portion between the outer peripheral wall surface of the cylinder liner and a phenol resin coat on the outer peripheral wall surface. In FIGS. 10 to 13, an upper portion that is darker is a resin portion, and a lower portion that is less dark is a cylinder liner portion.

Figure 10:
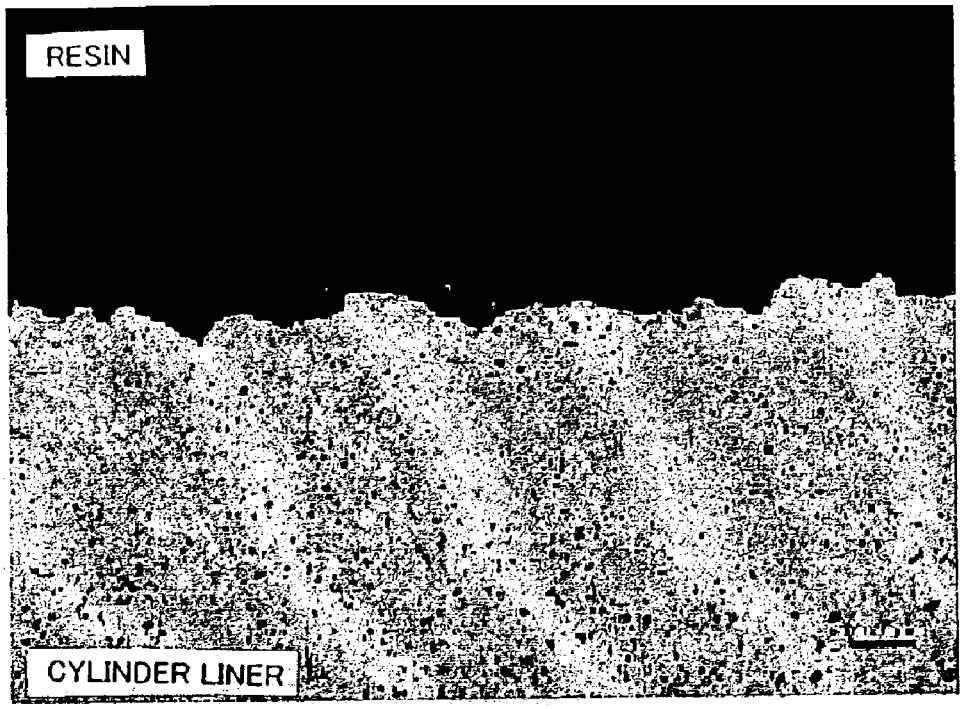
FIG. 10 is a photograph of a section of a portion that includes a boundary between a resin and the cylinder liner of Comparative Example 1.
Figure 11:
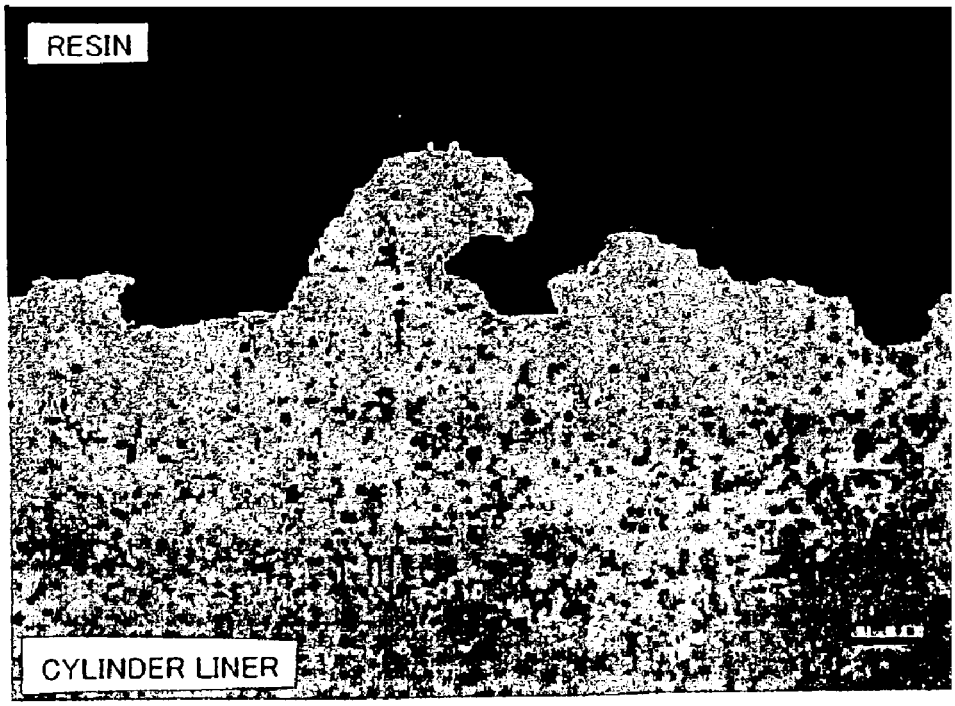
FIG. 11 is a photograph of a section of a portion that includes a boundary between a resin and the cylinder liner of Example 1.
Figure 12:
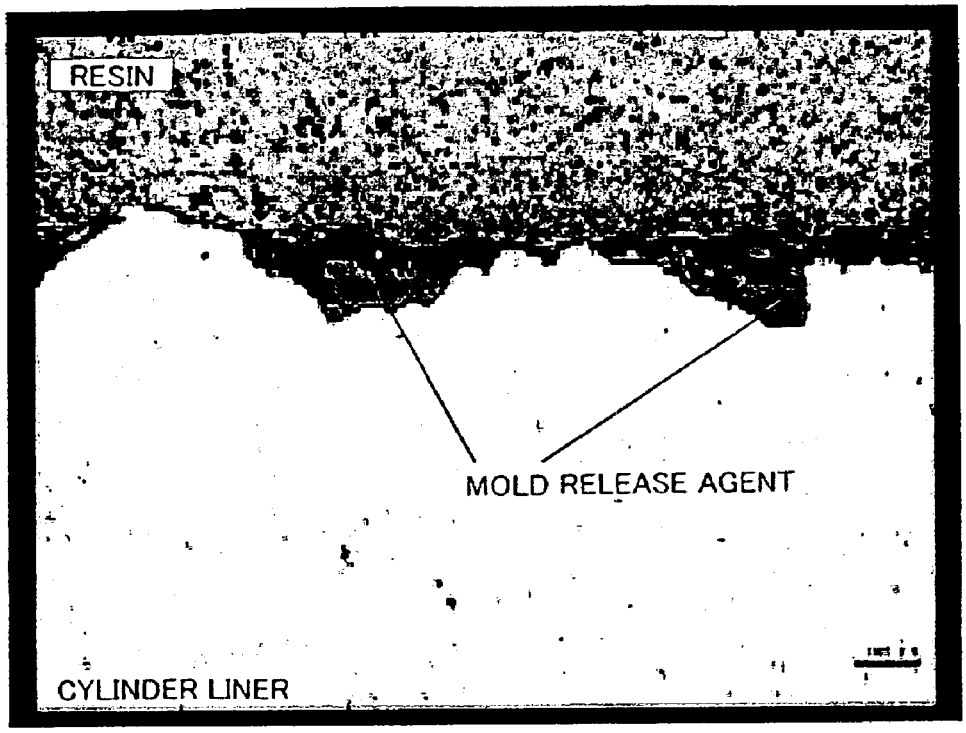
FIG. 12 is a photograph of a section of a portion including a boundary between the resin and the outer peripheral wall surface of the cylinder liner of Comparative Example 1, which was taken so as to show the presence of a mold release agent.

Each of FIGS. 10 and 12 is a photograph of a section of a portion around a boundary between the resin and the outer peripheral wall surface of the cylinder liner of Comparative Example 1. Each of FIGS. 11 and 13 is a photograph of a section of a portion around a boundary between the resin and the outer peripheral wall surface of the cylinder liner of Example 1.

As shown in FIG. 10, the outer peripheral wall surface of the cylinder liner of Comparative Example 1 at the stage after the shot blast has asperities. The asperities on the outer peripheral wall surface of the cylinder liner of Comparative Example 1 are simple asperities, compared with the protrusions formed on the outer peripheral wall surface of the cylinder liner of Example 1 subjected to the erosion-wash step performed by high-pressure water jet shown in FIG. 11. The small protrusions formed on the outer peripheral wall surface shown in FIG. 11 have complicated shapes. The small protrusions include key-shaped small protrusions, and also include key-shaped small protrusions that are curved toward the outer peripheral wall surface. A conceivable reason for the formation of the complicated-shape small protrusions is that portions of the base structure of cast iron forming the outer peripheral wall surface of the cylinder liner were eroded by impacts of high-pressure water jet.

Figure 13:
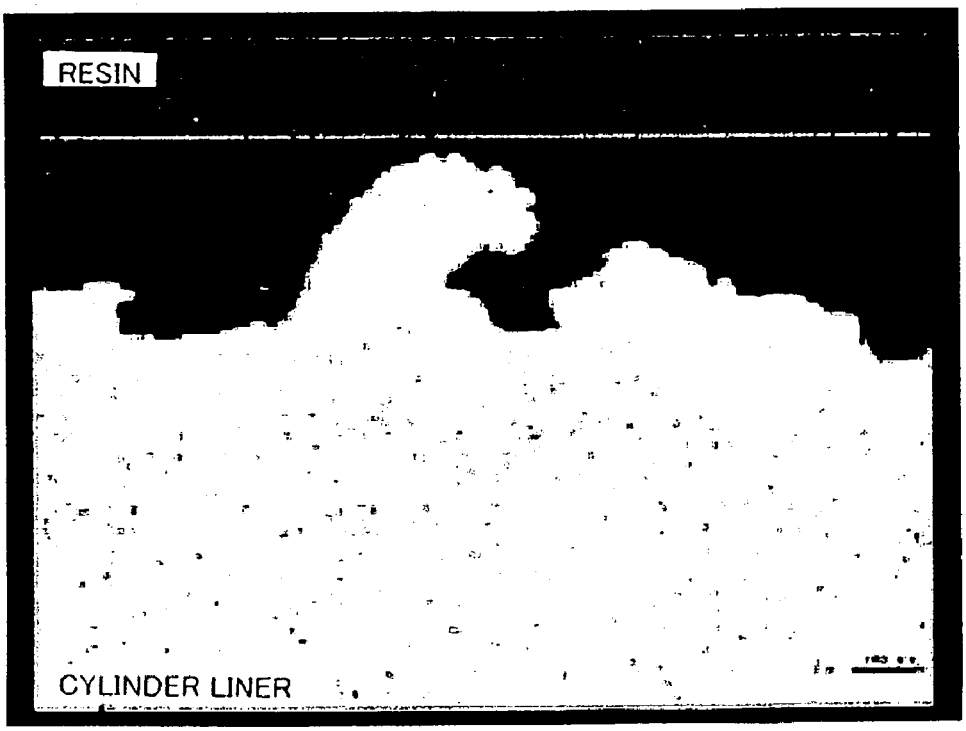
FIG. 13 is a photograph of a section of a portion including a boundary between the resin and the outer peripheral wall surface of the cylinder liner of Example 1, which was taken so as to show the presence of a mold release agent.

FIGS. 12 and 13 are photographs for observation of the presence of the mold release agent between the resin and the outer peripheral wall surface of the cylinder liner. In FIG. 12, the mold release agent is present between the resin and the outer peripheral wall surface of the cylinder liner. In contrast, in FIG. 13, no mold release agent is observed between the resin and the outer peripheral wall surface of the cylinder liner. That is, it can be understood that sand on the cylinder liner surface can be removed by the erosion-wash step performed by high-pressure water jet.

Although not clearly seen from these figures, it was observed by the unaided eye that the outer peripheral wall surface of the cylinder liner of Comparative Example 1 subjected merely to the shot blast was covered with a black scale of an iron oxide coating, whereas the outer peripheral wall surface of the cylinder liner of Example 1 subjected to the erosion-wash step performed by high-pressure water jet did not have such a black scale, and but had a silvery gloss.

The cast iron in Example 1 was a flake graphite cast iron having a D-type graphite (supercooled graphite) as can be observed in the cylinder liner portions in FIGS. 10 and 11. It can be considered that with the presence of many small D-type graphite portions in the flake graphite cast iron surface, cracks form mainly at boundaries between the graphite and the base structure, and interiors of the graphite, so that portions of the base structure were eroded.

(2) As Example 2 of the cylinder block production method of the invention, a cylinder block was produced as described below.

A tubular cylinder liner of a flake graphite cast iron (FC 230) having an inside diameter of 79 mm, an outside diameter of 89 mm and a length of 136 mm was produced by gravity casting. Due to the gravity casting of the flake graphite cast iron, a flake graphite having an ordinary A-type graphite was formed up to the surface.

The cylinder liner was cast through the use of a mold having an inner surface lined with sand (silica sand $SiO_2$). Therefore, at the stage where the cylinder liner was cast, the sand and the mold release agent from the mold were stuck on the outer peripheral wall surface of the cylinder liner.

As in Example 1, considering that a cast cylinder liner is normally subjected to a shot blast process so as to remove the sand and the mold release agent adhered to the outer peripheral wall surface of the cylinder liner in the related art, shot blast was also performed on the outer peripheral wall surface of the cylinder liner formed by centrifugal casting in this example.

The shot blast was performed by using alumina particles (#24) as a grid in the condition that the amount of grid projection was 135 g/min., and the grid speed was 60 m/sec., and the processing time was 0.07 sec./$cm^2$. As a result, asperities were formed to a certain degree on the outer peripheral wall surface of the cylinder liner, with dip portions of the asperities substantially filled with residual mold release agent.

The outer peripheral wall surface of the cylinder liner subjected to the above-described shot blast was then subjected to a machining process. The machining process was performed by using a lathe. As for the lathe, the rotation speed was set at 1500 rpm, and the feed speed was set at 0.6 m/min., and the amount of cut was set at 0.1 mm. The need for machining is not particularly found in real embodiments. In this example, however, the machining process of smoothing the outer peripheral wall surface of the cylinder liner to a certain degree of smoothness was performed, so that the high-pressure water jet onto the smoothed outer peripheral wall surface made it possible to check the effect of the erosion-wash step in the cylinder block production method of the invention.

The outer peripheral wall surface of the cylinder liner machined by using the lathe as described above was subjected to the erosion-wash step of the embodiment described above. The erosion-wash step in this example will be described with reference to FIG. 1, which is referred to above in conjunction with description of the embodiments. Components and elements similar to those shown in FIG. 1 will be represented by the reference characters used in FIG. 1.

As described above, the cylinder liner A was fixed to a chuck B so that the cylinder liner A was rotatable about an axis of the cylinder liner A.

Then, while the cylinder liner A was rotated at a rotation speed of 200 rpm via the cylinder liner A, high-pressure water was jetted from the nozzle C to the outer peripheral wall surface AS of the cylinder liner A. The pressure of high-pressure water was 270 MPa. The flow rate of high-pressure water was 3.55 L/min. The nozzle diameter of the nozzle C used was 0.38 mm. The moving speed of the nozzle C was set at 1 mm/min. The nozzle C used was a fan-jet nozzle that caused atomization of high-pressure water at a distance of 10 mm from the high-pressure water outlet (outlet orifice). The distance from the outlet of the nozzle C to the outer peripheral wall surface of the cylinder liner was set at 12.5 mm.

In the aforementioned conditions, the outer peripheral wall surface AS of the cylinder liner A was subjected to the erosion-wash step performed by high-pressure water jet, thereby eroding portions of the base structure of the outer peripheral wall surface AS of the cylinder liner.

Then, the cylinder liner was subjected to the same cast-enclosing step as in Example 1, so that a cylinder block was produced by casting an aluminum alloy (ADC 12) around the cylinder liner.

As Comparative Example 2 for a comparison purpose, a cylinder liner subjected to the shot blast process and the machining process but not subjected to the erosion-wash step performed by high-pressure water jet was subjected to the same cast-enclosing step as in Example 1, so that a cylinder block was produced by casting the aluminum alloy around the cylinder liner.

Figure 14:
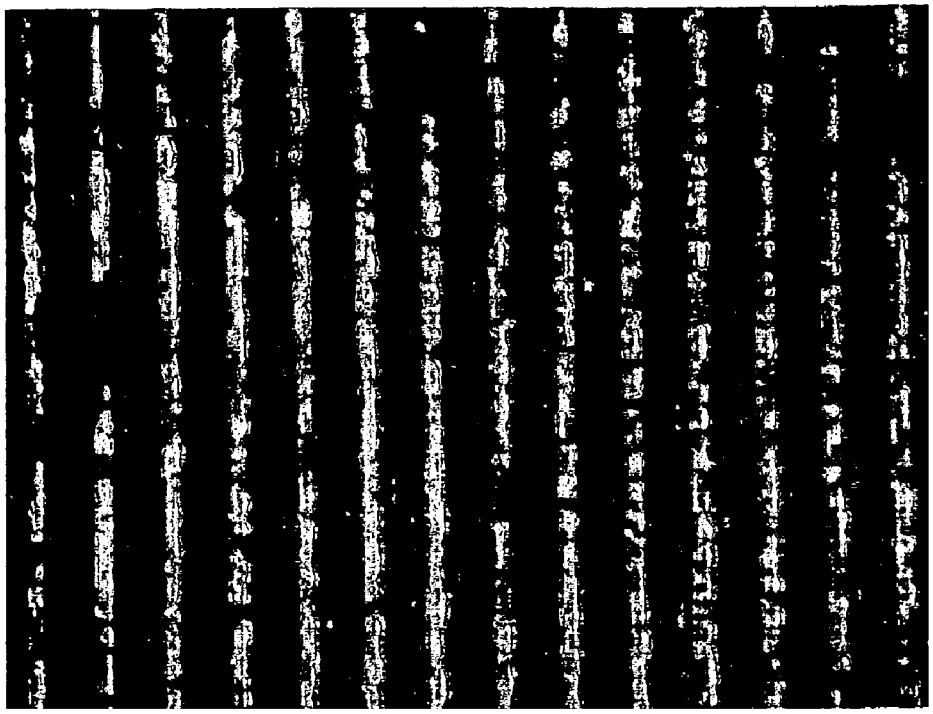
FIG. 14 is a magnified photograph of the outer peripheral wall surface of a cylinder liner of Comparative Example 2 subjected to the shot blast process and the machining process but not subjected to the erosion-wash step by high-pressure water jet.
Figure 15:
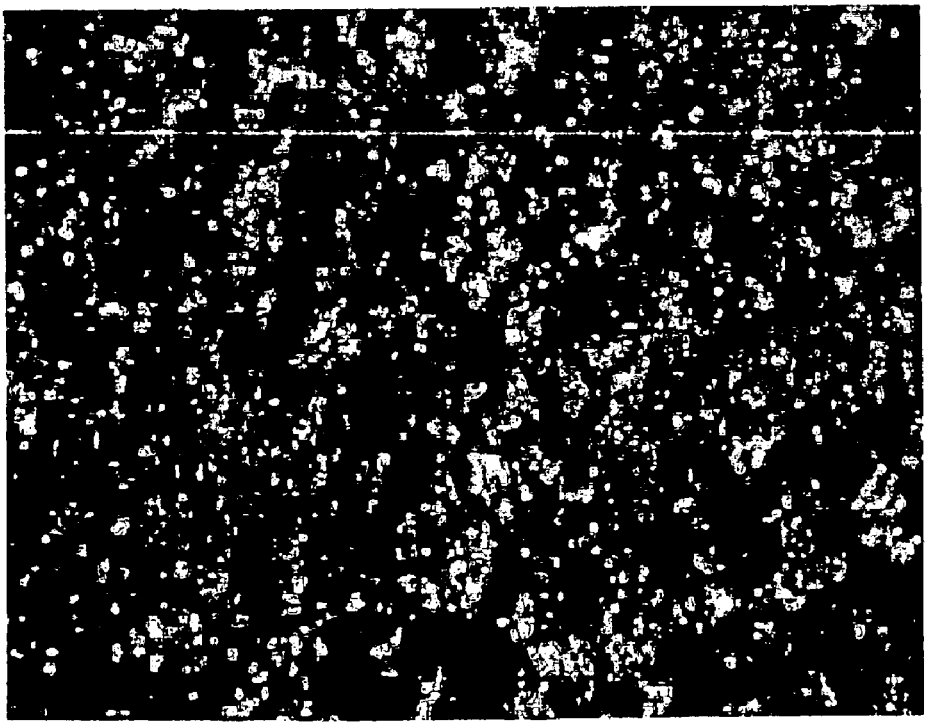
FIG. 15 is a magnified photograph of the outer peripheral wall surface of a cylinder liner of Example 2 subjected to the shot blast process, the machining process, and the erosion-wash step by high-pressure water jet.

FIG. 14 shows a magnified photograph of the outer peripheral wall surface of the cylinder liner subjected to the shot blast process and the machining process but not subjected to the erosion-wash step in Comparative Example 2. FIG. 15 shows a magnified photograph of the outer peripheral wall surface of the cylinder liner subjected to the shot blast process, the machining process, and the erosion-wash step performed by high-pressure water jet in Example 2. Comparison between FIG. 14 and FIG. 15 tells that the outer peripheral wall surface of the cylinder liner of Example 2 subjected to the high-pressure water jet in FIG. 15 has more complicated asperities than the outer peripheral wall surface of the cylinder liner of Comparative Example 2 subjected to high-pressure water jet in FIG. 14. In FIG. 14, the outer peripheral wall surface of the cylinder liner subjected to the machining process exhibits stripe-like machining marks.

Figure 16:
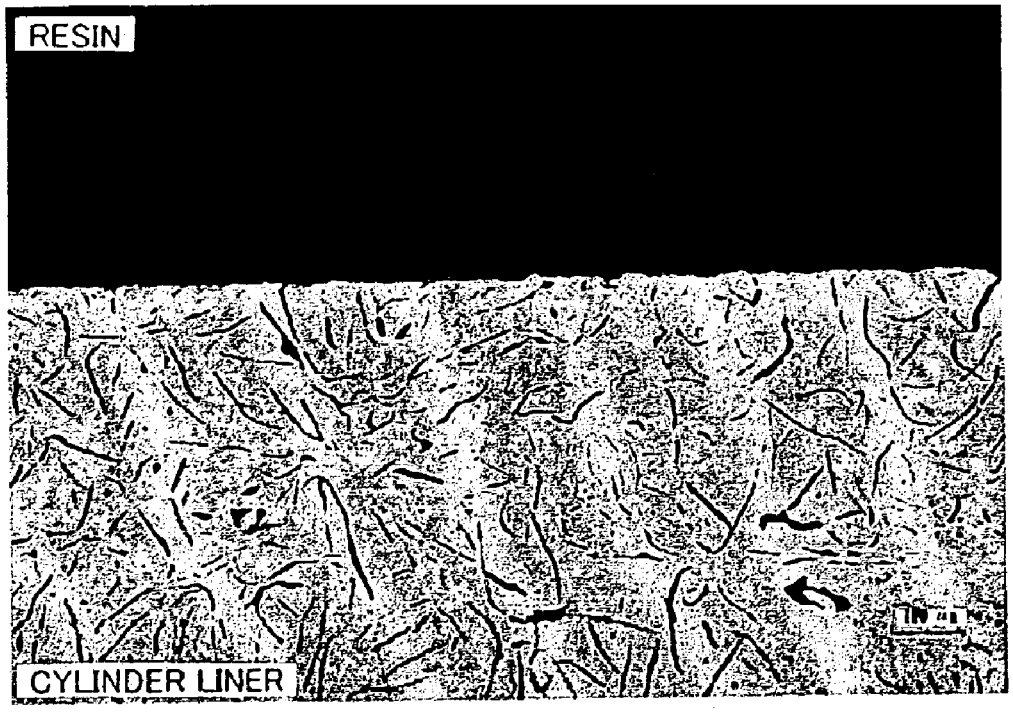
FIG. 16 is a photograph of a section of a portion that includes a boundary between a resin and the cylinder liner of Comparative Example 2.
Figure 17:
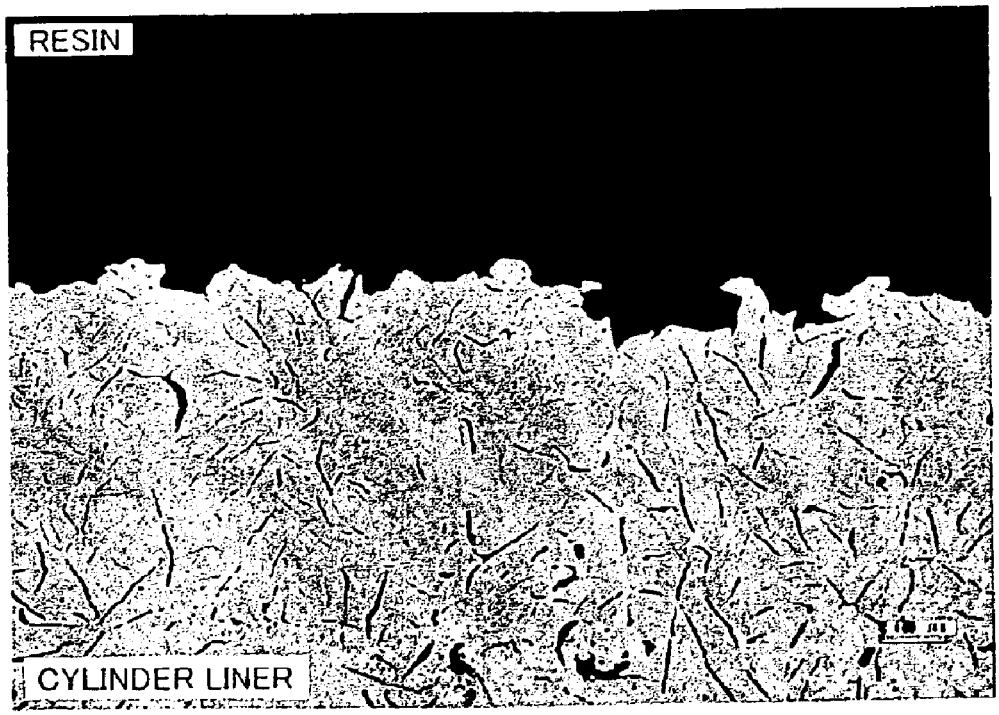
FIG. 17 is a photograph of a section of a portion that includes a boundary between a resin and the cylinder liner of Example 2.

Each of FIGS. 16 and 17 shows a photograph of a section of a boundary portion between the outer peripheral wall surface of the cylinder liner and a phenol resin coat on the outer peripheral wall surface. In FIGS. 16 and 17, an upper portion that is darker is a resin portion, and a lower portion that is less dark is a cylinder liner portion.

FIG. 16 shows a photograph of a portion around a boundary between the resin and the outer peripheral wall surface of the cylinder liner of Comparative Example 2 at a stage of having been subjected to the machining process. FIG. 17 shows a photograph of a portion around a boundary between the resin and the outer peripheral wall surface of the cylinder liner of Example 2 subjected to the erosion-wash step performed by high-pressure water jet. The gray cast iron was an ordinary flake graphite cast iron. That is, the gray cast iron herein was a flake graphite cast iron whose graphite was an A-type graphite.

Since the outer peripheral wall surface of the cylinder liner of Comparative Example 2 shown in FIG. 16 was subjected to the machining process, the outer peripheral wall surface shown in FIG. 16 is a smooth surface without small asperities. Although not shown in these figures, metallic irregular reflection was observed on the outer peripheral wall surface of the cylinder liner of Example 2 subjected to the erosion-wash step performed by high-pressure water jet, and glistening due to the machining process was observed on the outer peripheral wall surface of the cylinder liner of Comparative Example 2 at the stage of having been subjected to the machining process.

It can be understood from FIG. 7 that if the erosion-wash step by high-pressure water jet is performed on the outer peripheral wall surface of the cylinder liner of Comparative Example 2 having substantially no asperity, complicated small protrusions are formed on the outer peripheral wall surface of the cylinder liner. The outer peripheral wall surface has key-shaped small protrusions. A conceivable reason for the existence of key-shaped small protrusions is that the jetted high-pressure water created cracks at and around boundaries between the base structure and graphite of the flake graphite cast iron, so that portions of the base structure fell off. Therefore, it can be understood that if the erosion-wash step be high-pressure water jet is performed on a cylinder liner having a smooth surface, small protrusions will be formed on the outer peripheral wall surface of the cylinder liner.

(3) Observation of Degree of Adhesion

With regard to the cylinder block of Example 1, the cylinder block of Comparative Example 1, the cylinder block of Example 2, and the cylinder block of Comparative Example 2, the degree of adhesion between the cylinder liner and the cylinder block body was investigated.

Figure 18:
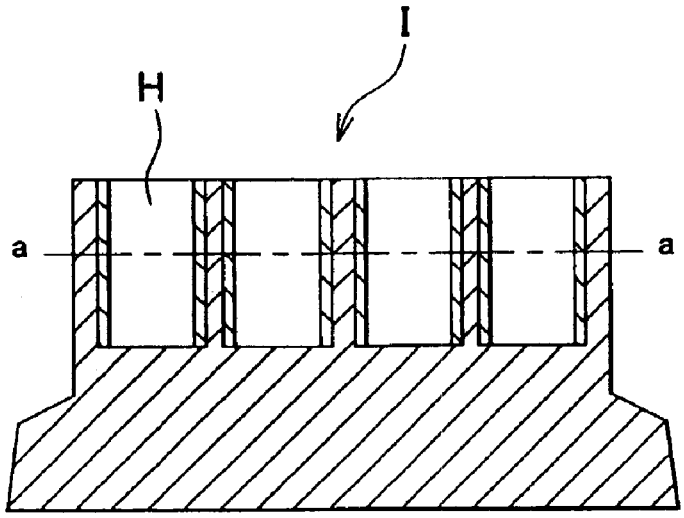
FIG. 18 is a diagram of a cylinder liner indicating the site of cutting.

Each of the cylinder blocks of Example 1, Comparative Example 1, Example 2 and Comparative Example 2 was cut as shown in FIG. 18. That is, the cylinder block H was cut perpendicularly to the axes of cylinder bores I as indicated by a line a—a in FIG. 18.

In the cut surface of each cylinder block, sites of good adhesion between the cylinder liner and the cylinder block body and sites where a gap is formed between the cylinder liner and the cylinder block body were microscopically observed and measured.

Figure 19:
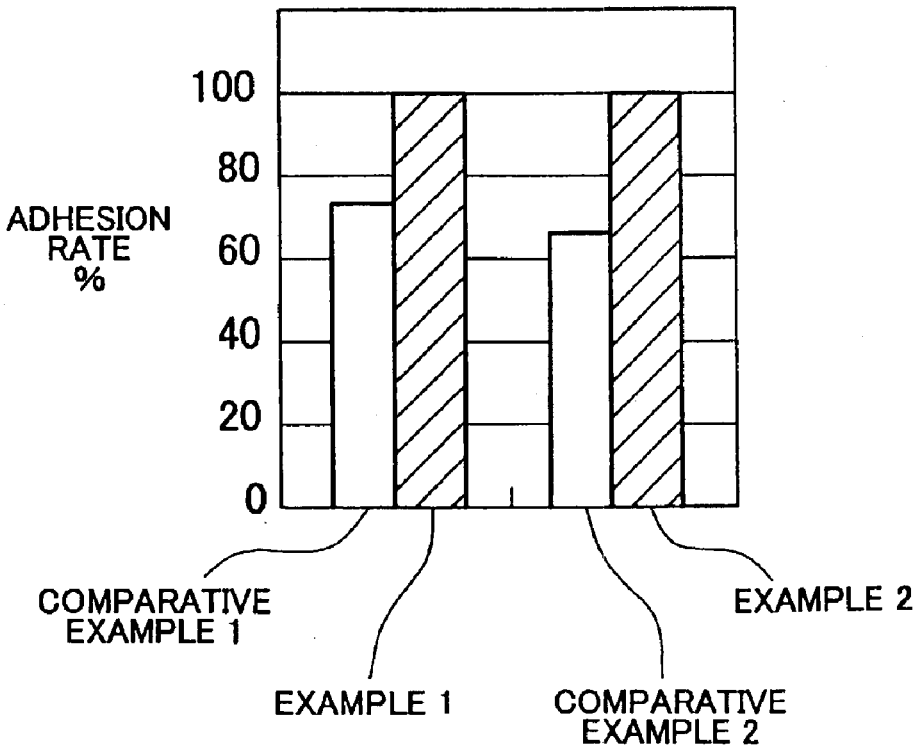
FIG. 19 is a graph indicating the rates of adhesion between the cylinder liner and the cylinder block body in the cylinder blocks of Example 1, Comparative Example 1, Example 2 and Comparative Example 2.

With the entire circumference of the outer peripheral wall surface of the cylinder liner defined as 100%, the proportion of sites of good adhesion to the cylinder block (adhesion proportion) was calculated. Results are shown in FIG. 19.

As for each of Examples 1 and 2, the adhesion proportion was 100%. A conceivable reason for the adhesion proportion being 100% is that the sand and the mold release agent deposited on the cylinder liner were removed by the erosion-wash step executed by high-pressure water jet in the cylinder block production method of the invention. A conceivable reason for the cylinder block of Comparative Example 1 having a lower adhesion proportion than the cylinder block of Example 1 is that the sand and the mold release agent could not be removed merely by the shot blast process. A conceivable reason for the cylinder block of Comparative Example 2 having a lower adhesion proportion than the cylinder block of Example 2 is that the machining process removed the sand and the mold release agent and, moreover, substantially eliminated asperities from the outer peripheral wall surface so that the attachment of the cast iron of the cylinder liner to the aluminum alloy of the cylinder block body reduced.

Each of the cylinder blocks of Example 1, Comparative Example 1, Example 2 and Comparative Example 2 was cut perpendicularly to the axes of the cylinder bores at a site where the cylinder liner was considered to be adhered to the cylinder block body.

The strength of adhesion between the cylinder block body and the cylinder liner was measured. The strength of adhesion was measured by a sheer adhesion test method.

Figure 20:
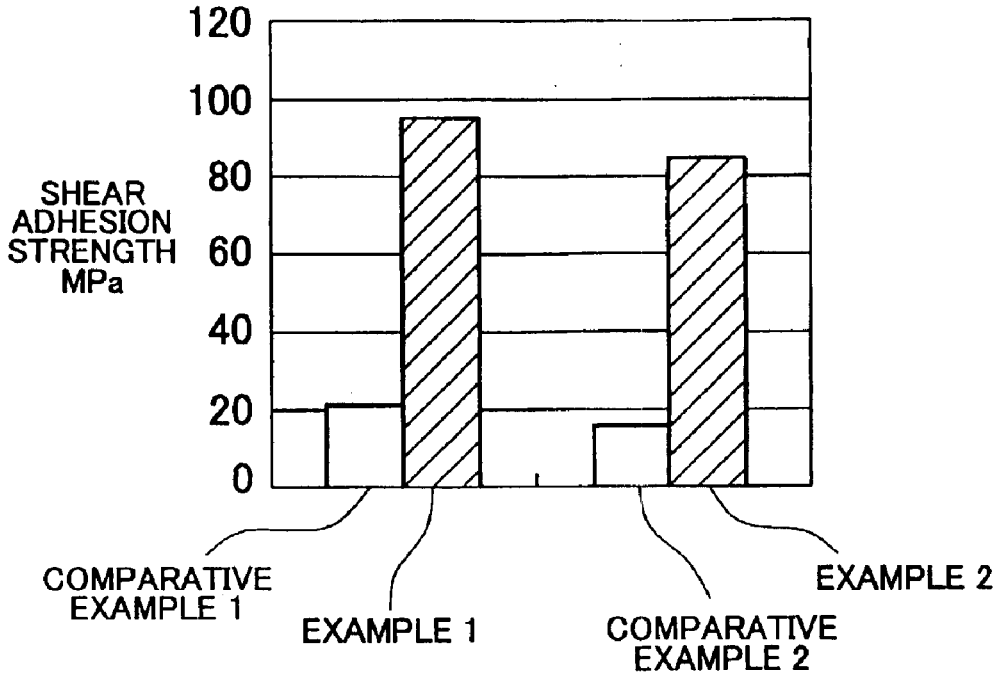
FIG. 20 is a graph indicating the strengths of adhesion between the cylinder liner and the cylinder block body in the cylinder blocks of Example 1, Comparative Example 1, Example 2 and Comparative Example 2.

Measurement results provided by the sheer adhesion test method are indicated in FIG. 20. It is clearly indicated that the cylinder blocks of Examples 1 and 2 had higher strengths of adhesion than the cylinder blocks of Comparative Examples 1 and 2. A conceivable reason for the higher adhesion strengths is that the cylinder liners of Examples 1 and 2 were substantially free from sand and the mold release agent, and the outer peripheral wall surface of each of the cylinder liners had complicated-shape small protrusions including key-shaped small protrusions. Although the cylinder liner of Comparative Example 1 had asperities, the asperities did not have a complicated shape, but were simple asperities. Furthermore, sand and the mold release agent remained at boundaries between the cylinder liner and the cylinder block body. Therefore, the strength of adhesion of Comparative Example 1 was low. In the cylinder block of Comparative Example 2, sand and the mold release agent were absent from the boundaries between the cylinder liner and the cylinder block body. However, due to the machining of a surface of the cylinder liner, seams formed by the machining were observed. The machining seams did not form such fine asperities as to improve the adhesion strength. Therefore, it is considered that the strength of adhesion of Comparative Example 2 was low.

The difference in adhesion strength between the cylinder block of Example 1 and the cylinder block of Example 2 can be considered as follows. The shot blast-treated outer peripheral wall surface of the cylinder block of Example 2 was smoothed by the machining process. Compared with the cylinder liner of the cylinder block of Example 1, the cylinder liner of Example 2 has a reduced amount of key-shaped small protrusions and a reduced degree of complicatedness of small protrusions.

(4) Measurement of Circularity

Figure 21:
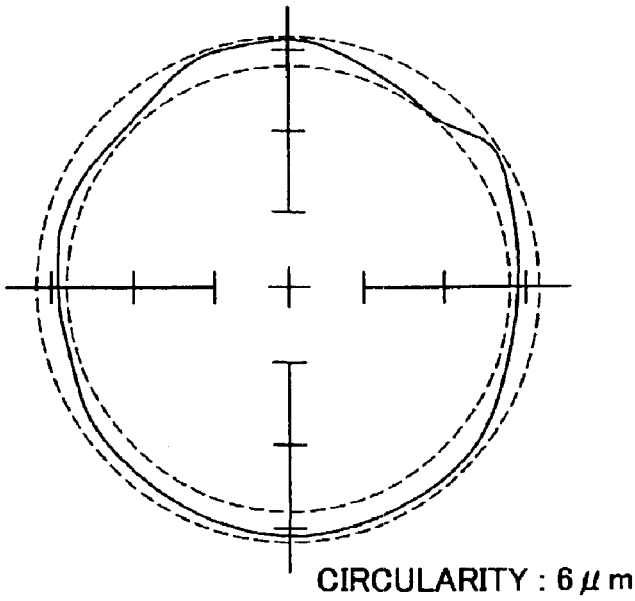
FIG. 21 is a diagram indicating the circularity of a cylinder bore of a cylinder block produced in Example 1.
Figure 22:
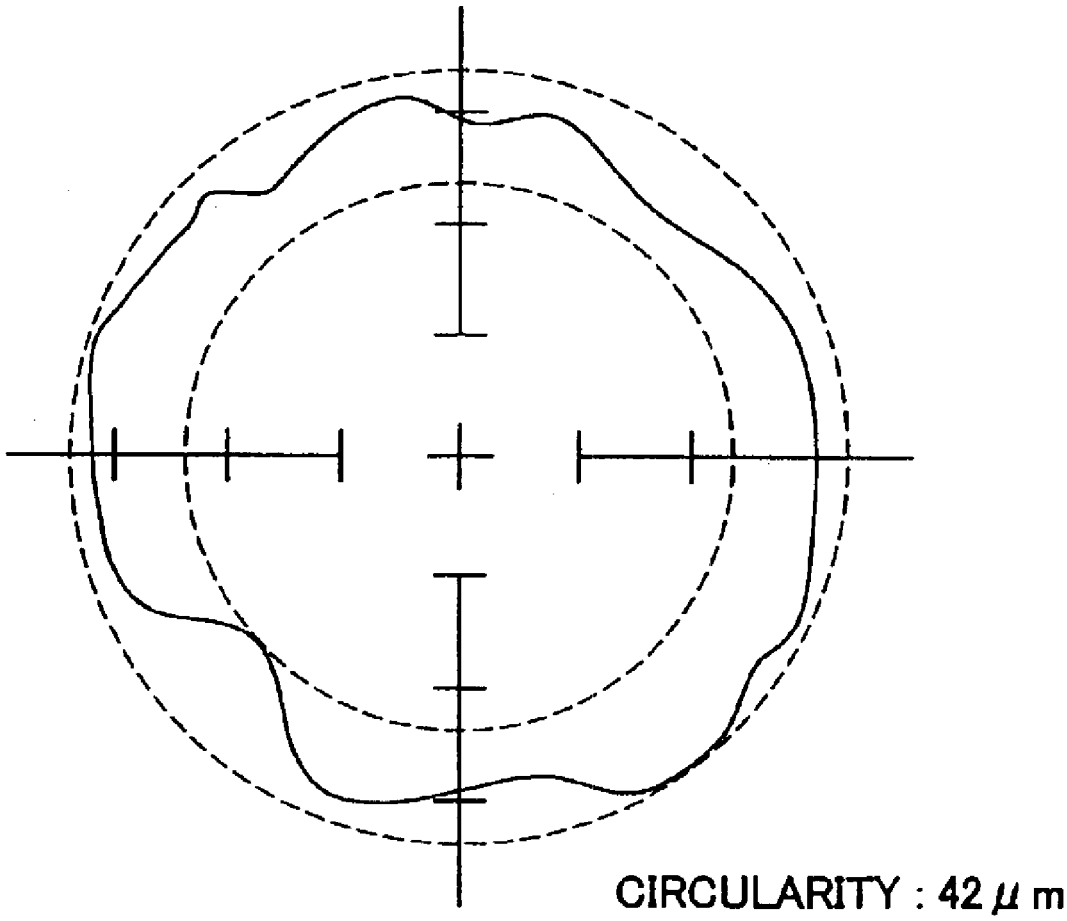
FIG. 22 is a diagram indicating the circularity of a cylinder bore of a cylinder block produced in Comparative Example 1.

A 100-hour engine operation test was performed on the cylinder block of Example 1 and the cylinder block of Comparative Example 1. After the test, the engine was disassembled, and circularity of cylinder bores was measured. FIG. 21 indicates the circularity of a cylinder bore of the cylinder block produced in Example 1. FIG. 22 indicates the circularity of a cylinder bore of the cylinder block produced in Comparative Example 1. The circularity of the cylinder bore of Example 1 was 6 $\mu$m, whereas the circularity of the cylinder bore of Comparative Example 1 was 42 $\mu$m.

A conceivable reason why the cylinder block of Example 1 had a considerably improved circularity compared with the cylinder block of Comparative Examples 1 is that the strength of adhesion between the cylinder liner and the cylinder block body improved so that the likelihood of development of gaps between the cylinder liner and the cylinder block body during operation of the engine considerably dropped, and therefore heat transfer during the operation of the engine was substantially uniform in the circumferential direction relative to the cylinder liner. That is, it is considered that due to uniform heat transfer in the circumferential direction relative to the cylinder liner, reduction of deformation of the cylinder bore was realized.

A reduction in the deformation of a cylinder bore will reduce the consumption of oil used for the cylinder bore, and will allow the ring tension to be reduced. As a result, friction will reduce, thus leading to reduced fuel consumption.

(5) As Example 3, a cylinder block was produced on the basis of the cylinder block production method of the invention.

A tubular cylinder liner of a flake graphite cast iron (FC 230) having an inside diameter of 79 mm, an outside diameter of 89 mm and a length of 136 mm was produced by centrifugal casting. The cylinder liner was cast through the use of a mold having an inner surface lined with sand (silica sand $SiO_2$). Therefore, at the stage where the cylinder liner was cast, the sand and the mold release agent from the mold were stuck on the outer peripheral wall surface of the cylinder liner.

Then, shot blast was also performed on the cylinder liner formed by centrifugal casting. The shot blast was performed by using alumina particles (#24) as a grid in the condition that the amount of grid projection was 135 g/min., and the grid speed was 60 m/sec., and the processing time was 0.07 sec./cm$^2$. As a result, asperities were formed to a certain degree on the outer peripheral wall surface of the cylinder liner, with dip portions of the asperities substantially filled with residual sand.

The cylinder liner subjected to the shot blast as described above was subjected to the erosion-wash step of the embodiment described above. The erosion-wash step in this example will be described with reference to FIG. 1, which is referred to above in conjunction with the description of the embodiments. Components and elements similar to those shown in FIG. 1 will be represented by the reference characters used in FIG. 1.

As described above, the cylinder liner A was fixed to a chuck B so that the cylinder liner A was rotatable about an axis of the cylinder liner A.

Then, while the cylinder liner A was rotated at a rotation speed of 200 rpm via the cylinder liner A, high-pressure water was jetted from the nozzle C to the outer peripheral wall surface AS of the cylinder liner A. The pressure of high-pressure water was 414 MPa. The flow rate of high-pressure water was 4.94 L/min. The nozzle diameter of the nozzle C used was 0.38 mm. The moving speed of the nozzle C was set at 2 mm/min. The nozzle C used was a fan-jet nozzle that caused atomization of high-pressure water at a distance of 10 mm from the high-pressure water outlet (outlet orifice). The distance from the outlet of the nozzle C to the outer peripheral wall surface of the cylinder liner was set at 12.5 mm.

In the aforementioned conditions, the outer peripheral wall surface AS of the cylinder liner A was subjected to the erosion-wash step performed by high-pressure water jet, thereby eroding portions of the base structure of the outer peripheral wall surface AS of the cylinder liner.

After the erosion-wash step, the cylinder liner was subjected to the cast-enclosing step so as to produce a cylinder block. In the cast-enclosing step, an aluminum alloy (ADC 12) was adopted for a cylinder block body, and was cast around the cylinder liner by die-casting.

As Comparative Example 1 for a comparison purpose, a cylinder liner subjected to the shot blast process but not subjected to the erosion-wash step performed by high-pressure water jet was subjected to the same cast-enclosing step as in Example 1, so that a cylinder block was produced by casting the aluminum alloy around the cylinder liner.

Figure 23:
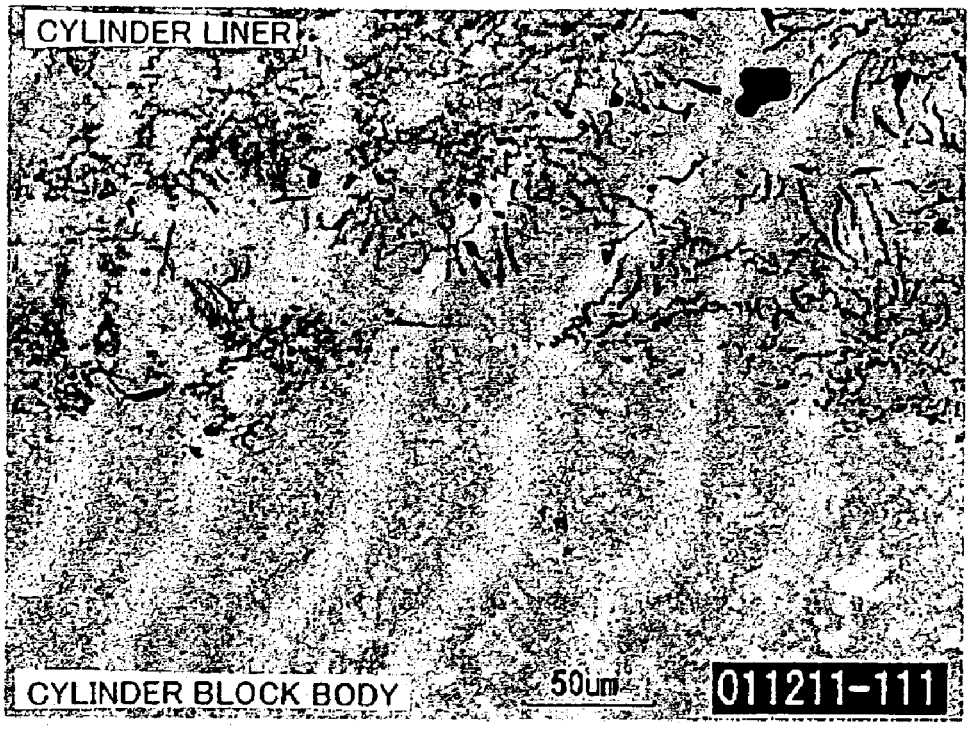
FIG. 23 is a photograph of a section of a cylinder block of Example 3, showing a portion including a boundary between the cylinder liner and the cylinder block body.
Figure 24:
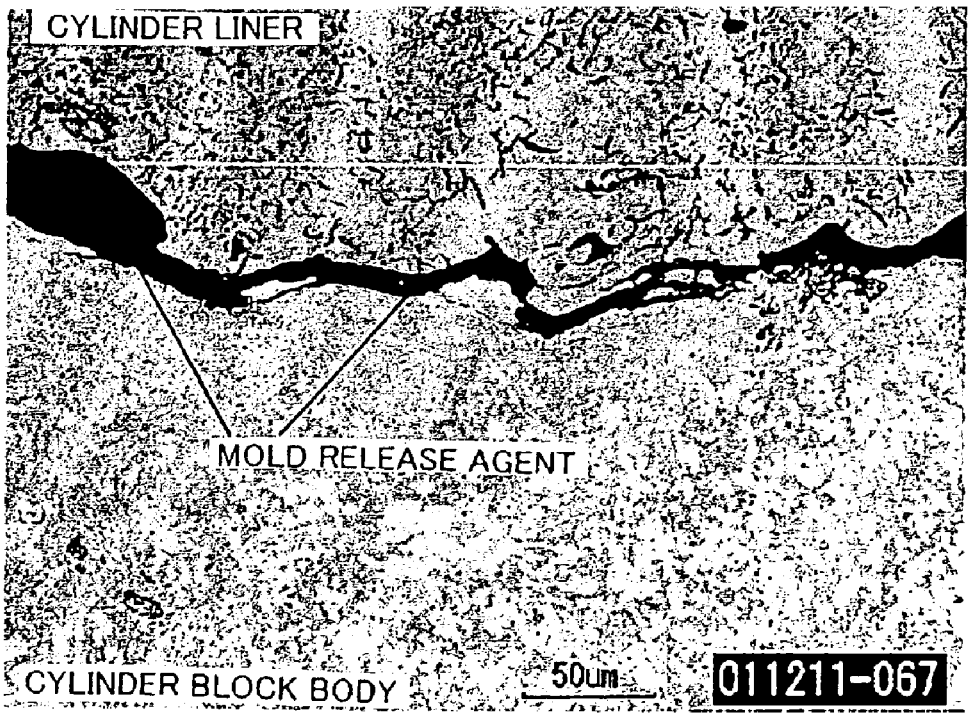
FIG. 24 is a photograph of a section of a cylinder block of Comparative Example 3, showing a portion including a boundary between the cylinder liner and the cylinder block body.

FIGS. 23 and 24 show magnified photographs of cut surfaces of the cylinder block of Example 3 and the cylinder block of Comparative Example 3 extending perpendicular to the axes of cylinder bores.

FIG. 23 shows a photograph of a section of the cylinder block of Example 3, showing a portion around a boundary between the cylinder liner and the cylinder block body. The photograph shows good adhesion between the flake graphite cast iron forming the cylinder liner and the aluminum alloy (ADC 12) forming the cylinder block body. The mold release agent is substantially absent at the boundary between the cylinder liner and the cylinder block body.

FIG. 24 is a photograph of a section of the cylinder block of Comparative Example 3, showing a portion around a boundary between the cylinder liner and the cylinder block body. The photograph shows the presence of the mold release agent at the boundary between the cylinder liner and the cylinder block body. This sand is considered to become a cause for reduction of the strength of adhesion between the cylinder liner and the cylinder block body of the cylinder block.

Figure 25:
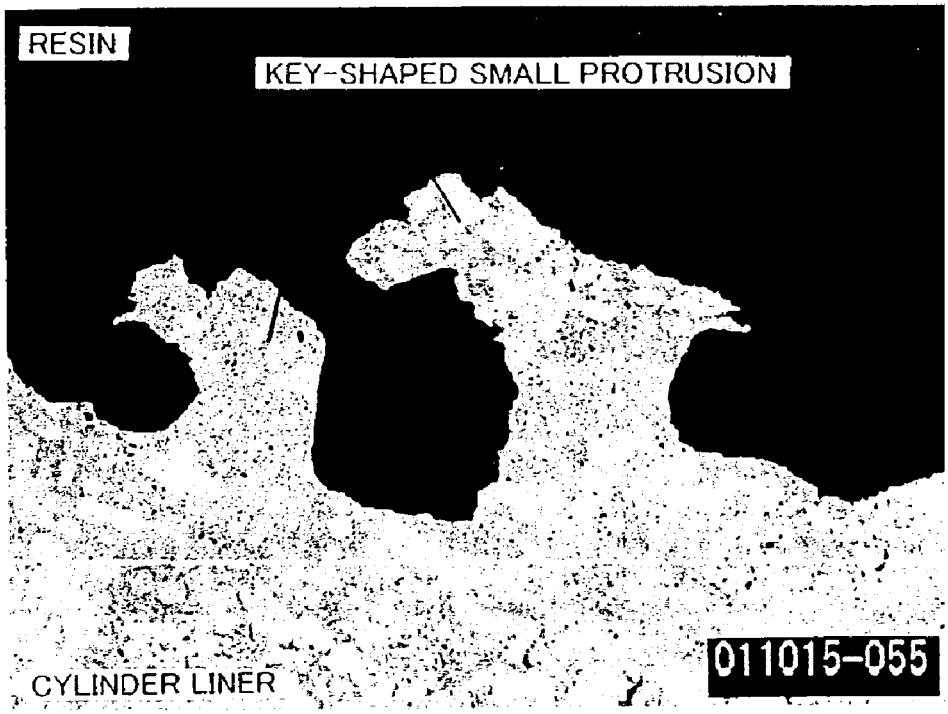
FIG. 25 is a photograph of key-shaped small protrusions formed on the outer peripheral wall surface of a cylinder liner.

[2] Execution of Erosion-wash Step by High-pressure Water Jet: Measurement of Small Protrusions on Outer Peripheral Wall Surface (1) FIG. 25 shows a photograph of key-shaped small protrusions each of which has a surface having an angle less than 90 degrees with respect to the outer peripheral wall surface of the cylinder liner. The cylinder liner was produced by centrifugal casting of gray cast iron (FC 230) so that the cylinder liner was formed of a flake graphite cast iron having a D-type graphite in a surface portion of the outer peripheral wall surface of the cylinder liner. The photograph shows a section of the outer peripheral wall surface of the cylinder liner subjected to the erosion-wash step performed by high-pressure water jet in the cylinder block production method of the invention. As for the configuration of the cylinder liner, the inside diameter thereof was 79 mm, and the outside diameter thereof was 89 mm, and the length thereof was 136 mm.

As for the process conditions of high-pressure water jet, the nozzle diameter was 0.38 mm, and the water pressure was 414 MPa, and the flow rate was 4.35 L/min. The moving speed of the nozzle was set at 2 mm/sec. The distance from the high-pressure water outlet of the nozzle to the outer peripheral wall surface of the cylinder liner was set at 12.5 mm. The nozzle used was a fan-jet nozzle that caused atomization of high-pressure water at a distance of 10 mm from the high-pressure water outlet (outlet orifice). The rotation speed of the cylinder liner was set at 200 rpm.

This sectional photograph was taken after the outer peripheral wall surface was coated with a resin, and was then cut perpendicularly to the axis of the cylinder liner. Therefore, an upper portion of the photograph that is darker is a resin portion, and a lower portion that is whitish is a cylinder liner portion.

FIG. 25 shows two key-shaped small protrusions. If the cylinder liner having an outer peripheral wall surface with such key-shaped small protrusions is enclosed with a cast material such as an aluminum alloy or the like, the key-shaped small protrusions become embedded in the surrounding cast material, thereby realizing firm adhesion.

(2) Measurement 1

The centrifugal-cast cylinder liner of a flake graphite cast iron (FC 230) in which a D-type graphite was formed near the surface was subjected to the erosion-wash described above in conjunction with the embodiment. As for the configuration of the cylinder liner, the inside diameter thereof was 79 mm, and the outside diameter thereof was 89 mm, and the length thereof was 136 mm.

The cylinder liner was fixed to a chuck. While the cylinder liner was being rotated, the erosion-wash step was performed by shifting the nozzle in the direction of the axis of the cylinder liner and jetting high-pressure water against the outer peripheral wall surface of the cylinder liner. The erosion-wash step was performed at a cylinder liner rotation speed of 200 rpm, and a nozzle moving speed of 2 mm/sec., with other high-pressure water jet conditions being varied. The distance from the high-pressure water outlet of the nozzle to the outer peripheral wall surface of the cylinder liner was set at 12.5 mm. The nozzle used was a fan-jet nozzle that caused atomization of high-pressure water at a distance of 10 mm from the high-pressure water outlet (outlet orifice).

Then, the number of key-shaped small protrusions formed on the outer peripheral wall surface of the cylinder liner, the amount of cut of the outer peripheral wall surface, and the roughness of the outer peripheral wall surface were measured. As for the measurement of the number of key-shaped small protrusions, the number of key-shaped small protrusions of at least 0.1 mm in height present in an area of 40 mm in circumferential length on the cylinder liner outer peripheral wall surface was counted at two sites on a cylinder liner, that is, two sites on a circumference line of the cylinder liner. Measurement results are shown in Table 1. In Table 1, the ten-point average roughness (Rz) and the center-line average roughness (Ra) are indicated in the unit of $\mu$m. In Table 1, the numbers of key-shaped small protrusions at two sites of measurement are shown in the columns of No. 1 and No. 2 of the number of protrusions.

TABLE 1

(Flake Graphite Cast Iron (Centrifugal Casting))

| Test | Nozzle diameter | | Water pressure | | Flow | Cut | Roughness | | Number of protrusions | | |
|---|---|---|---|---|---|---|---|---|---|---|---|
| No. | mm | inch | MPa | Psi | L/min | mm | Ra | Rz | No. 1 | No. 2 | Total |
| No. 1 | 0.13 | 0.005 | 414 | 60000 | 0.48 | 0.48 | 11 | 89 | 0 | 0 | 0 |
| No. 2 | 0.18 | 0.007 | 414 | 60000 | 0.95 | 0.95 | 11 | 92 | 0 | 0 | 0 |
| No. 3 | 0.25 | 0.01 | 414 | 60000 | 1.93 | 1.93 | 12 | 92 | 0 | 0 | 0 |
| No. 4 | 0.33 | 0.013 | 414 | 60000 | 3.26 | 3.26 | 14 | 98 | 1 | 4 | 5 |
| No. 5 | 0.36 | 0.014 | 345 | 50000 | 3.46 | 3.46 | 13 | 99 | 10 | 5 | 9 |
| No. 6 | 0.36 | 0.014 | 379 | 55000 | 3.62 | 3.62 | 14 | 100 | 6 | 9 | 15 |
| No. 7 | 0.36 | 0.014 | 414 | 60000 | 3.79 | 3.79 | 16 | 124 | 11 | 18 | 29 |
| No. 8 | 0.38 | 0.015 | 310 | 45000 | 3.76 | 3.76 | 18 | 122 | 12 | 13 | 25 |
| No. 9 | 0.38 | 0.015 | 345 | 50000 | 4.16 | 4.16 | 17 | 135 | 16 | 13 | 29 |
| No. 10 | 0.38 | 0.015 | 379 | 55000 | 4.35 | 4.35 | 19 | 136 | 21 | 22 | 43 |
| No. 11 | 0.38 | 0.015 | 414 | 60000 | 4.57 | 4.57 | 22 | 168 | 20 | 15 | 35 |
| No. 12 | 0.41 | 0.016 | 241 | 35000 | 3.78 | 3.78 | 20 | 126 | 14 | 11 | 25 |
| No. 13 | 0.41 | 0.016 | 310 | 45000 | 4.28 | 4.28 | 23 | 123 | 18 | 21 | 39 |

TABLE 1-continued (Flake Graphite Cast Iron (Centrifugal Casting))

| Test | Nozzle diameter | | Water pressure | | Flow | Cut | Roughness | | Number of protrusions | | |
|---|---|---|---|---|---|---|---|---|---|---|---|
| No. | mm | inch | MPa | Psi | L/min | mm | Ra | Rz | No. 1 | No. 2 | Total |
| No. 14 | 0.41 | 0.016 | 345 | 50000 | 4.51 | 4.51 | 22 | 140 | 17 | 19 | 36 |
| No. 15 | 0.41 | 0.016 | 414 | 60000 | 4.94 | 4.94 | 25 | 141 | 17 | 21 | 40 |

The present inventors have recognized through research that the number of key-shaped small protrusions greater than 10 is effective in improving the adhesion strength. A relationship between the number of key-shaped small protrusions and the flow rate of high-pressure water which can be grasped from Table 1 is indicated in FIG. 26.

Figure 26:
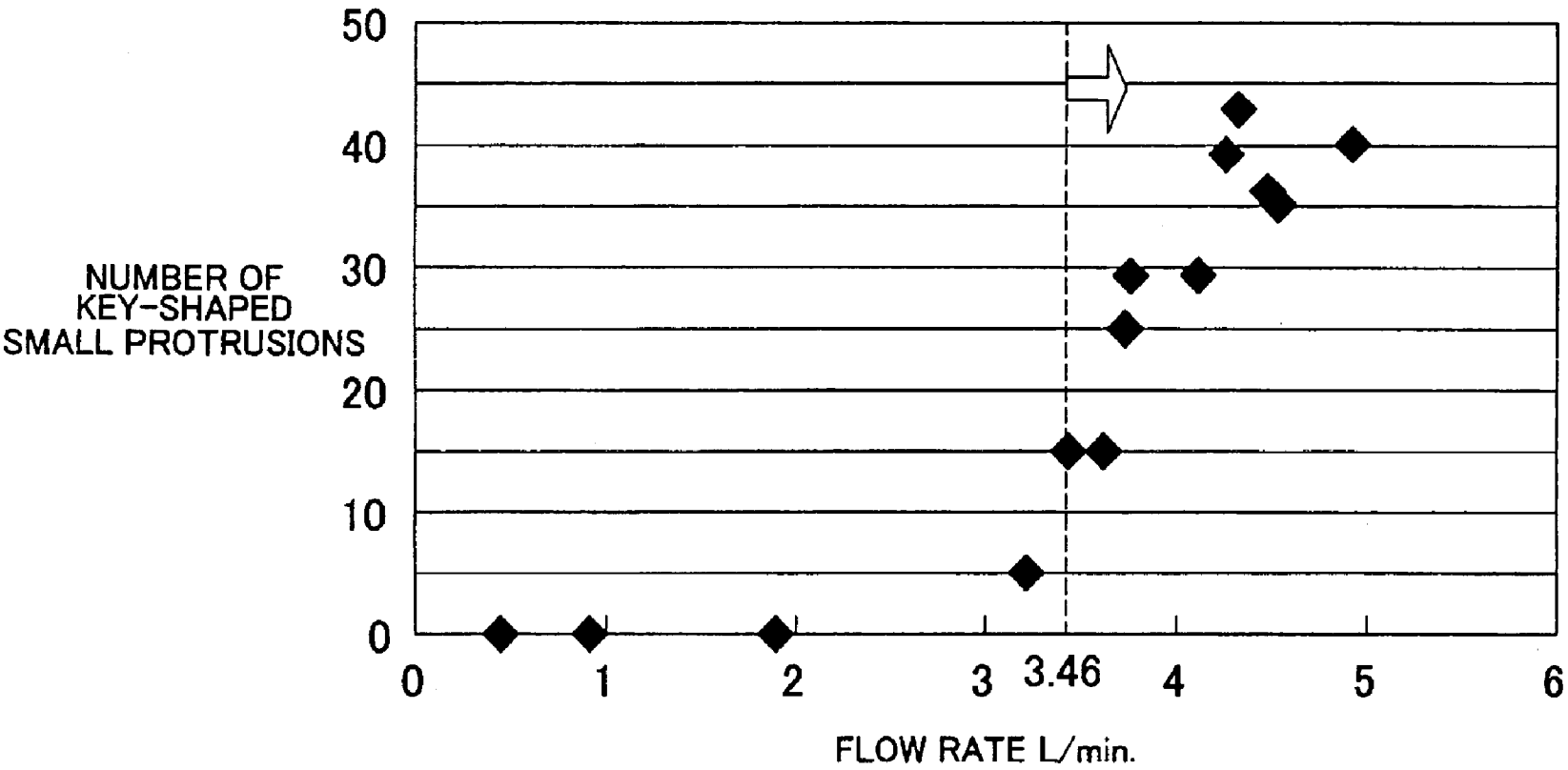
FIG. 26 is a graph indicating a relationship between the number of key-shaped small protrusions and the flow rate of high-pressure water which can be grasped from Table 1.

From Table 1 and FIG. 26, it can be understood that the number of key-shaped small protrusions in total is 10 or greater if the high-pressure water jet was performed at a flow rate greater than 3.62 L/min., that is, if high-pressure water was jetted in the conditions of No. 6 to No. 15. Therefore, it has been found that key-shaped small protrusions can be formed so as to satisfy the adhesion strength requirement by performing high-pressure water jet on the cylinder liner produced from a gray cast iron (FC 230) by centrifugal casting, in the conditions of No. 6 to No. 15.

Therefore, from Table 1, it can be understood that in order to form at least 10 key-shaped small protrusions, the water pressure of 345 MPa or higher and the flow rate of 3.46 L/min. or greater are preferable if the nozzle diameter is 0.36 mm. It is also understood that if the nozzle diameter is 0.38 mm, the water pressure of 310 MPa or higher and the flow rate of 3.76 L/min. are sufficient to form at least 10 key-shaped small protrusions. It is also understood that if the nozzle diameter is 0.41 mm, the water pressure of 241 MPa or greater and the flow rate of 3.78 L/min. or greater are sufficient to form at least 10 key-shaped small protrusions.

(3) Measurement 2

The erosion-wash step was performed with varied conditions of high-pressure water jet, on centrifugal-cast cylinder liners of a flake graphite cast iron (FC 230) in which a D-type graphite was formed near the surfaces, and cylinder liners produced from different materials. The configuration of the cylinder liners were the same as in Measurement 1, that is, the inside diameter thereof was 79 mm, and the outside diameter thereof was 89 mm, and the length thereof was 136 mm.

Measurement 2 differs from Measurement 1 in that all the nozzles used for high-pressure water jet had a diameter of 0.38 mm while variations were made in the water pressure, the rotation speed of the cylinder liner fixed to the chuck, and the moving speed of the nozzle in the direction of the axis of the cylinder liner. The distance from the high-pressure water outlet of the nozzle to the outer peripheral wall surface of the cylinder liner was set at 12.5 mm. The nozzles used were fan-jet nozzles that caused atomization of high-pressure water at a distance of 10 mm from the high-pressure water outlet (outlet orifice).

When the water pressure was 310 MPa, the flow rate was 3.76 L/min. When the water pressure was 345 MPz, the flow rate was 4.16 L/min. When the water pressure was 379 MPz, the flow rate was 4.35 L/min. When the water pressure was 414 MPa, the flow rate was 4.57 L/min.

Similarly to the above-described measurement, the number of key-shaped small protrusions formed on the outer peripheral wall surface of the cylinder liner, the amount of cut of the outer peripheral wall surface, and the roughness of the outer peripheral wall surface were measured. As for the measurement of the number of key-shaped small protrusions, the number of key-shaped small protrusions of at least 0.1 mm in height present in an area of 40 mm in circumferential length on the cylinder liner outer peripheral wall surface was counted at two sites on a cylinder liner, that is, two sites on a circumference line of the cylinder liner.

Table 2 shows measurement results regarding the outer peripheral wall surfaces of the centrifugal-cast cylinder liners of a flake graphite cast iron (FC 230) in which a D-type graphite was formed near the surfaces. Table 3 shows measurement results regarding the outer peripheral wall surfaces of the cylinder liners formed from other materials.

The materials used to produce the cylinder liners of No. 36 to No. 39 in Table 3 will be indicated below.

In No. 36, the cylinder liner was formed from a flake graphite cast iron (FC 230) by gravity casting. In No. 37, the cylinder liner was formed from a spheroidal graphite cast iron. In No. 38, the cylinder liner was formed from a carbon steel (JIS G 4051 S45C). In No. 39, the cylinder liner was formed from a heat resisting steel bar (JIS G 4311 SUS304).

In Tables 2 and 3, the ten-point average roughness (Rz) and the center-line average roughness (Ra) are indicated in the unit of $\mu$m. In Tables 2 and 3, the numbers of key-shaped small protrusions at two sites of measurement are shown in the columns of No. 1 and No. 2 of the number of protrusions.

TABLE 2

(Flake Graphite Cast Iron (Centrifugal Casting))

| Test | Water pressure | | Rotation | Speed | Cut | Roughness | | Number of protrusions | | |
|---|---|---|---|---|---|---|---|---|---|---|
| No. | MPa | Psi | rpm | mm/sec | mm | Ra | Rz | No. 1 | No. 2 | Total |
| No. 16 | 310 | 45000 | 200 | 1 | 0.16 | 17 | 141 | 18 | 13 | 31 |
| No. 17 | 345 | 50000 | 200 | 1 | 0.19 | 11 | 138 | 15 | 9 | 24 |
| No. 18 | 379 | 55000 | 200 | 1 | 0.22 | 15 | 140 | 13 | 10 | 23 |
| No. 19 | 414 | 60000 | 200 | 1 | 0.23 | 11 | 104 | 7 | 9 | 16 |

TABLE 2-continued (Flake Graphite Cast Iron (Centrifugal Casting))

| Test | Water pressure | | Rotation | Speed | Cut | Roughness | | Number of protrusions | | |
|---|---|---|---|---|---|---|---|---|---|---|
| No. | MPa | Psi | rpm | mm/sec | mm | Ra | Rz | No. 1 | No. 2 | Total |
| No. 20 | 379 | 55000 | 500 | 1 | 0.17 | 15 | 150 | 21 | 13 | 34 |
| No. 21 | 414 | 60000 | 500 | 1 | 0.31 | 11 | 151 | 16 | 10 | 26 |
| No. 22 | 310 | 45000 | 200 | 2 | 0.17 | 15 | 152 | 14 | 7 | 21 |
| No. 23 | 345 | 50000 | 200 | 2 | 0.15 | 17 | 137 | 13 | 10 | 23 |
| No. 24 | 379 | 55000 | 200 | 2 | 0.23 | 21 | 171 | 6 | 16 | 22 |
| No. 25 | 414 | 60000 | 200 | 2 | 0.24 | 18 | 153 | 19 | 18 | 37 |
| No. 26 | 379 | 55000 | 500 | 2 | 0.19 | 13 | 103 | 12 | 11 | 23 |
| No. 27 | 414 | 60000 | 500 | 2 | 0.22 | 15 | 110 | 16 | 9 | 25 |
| No. 28 | 345 | 50000 | 200 | 3 | 0.12 | 11 | 115 | 20 | 19 | 39 |
| No. 29 | 379 | 55000 | 200 | 3 | 0.09 | 20 | 160 | 10 | 11 | 21 |
| No. 30 | 414 | 60000 | 200 | 3 | 0.12 | 24 | 169 | 21 | 17 | 38 |
| No. 31 | 379 | 55000 | 500 | 3 | 0.1 | 16 | 132 | 11 | 11 | 22 |
| No. 32 | 414 | 60000 | 500 | 3 | 0.12 | 20 | 164 | 13 | 16 | 29 |
| No. 33 | 414 | 60000 | 200 | 4 | 0.11 | 17 | 135 | 17 | 13 | 30 |
| No. 34 | 414 | 60000 | 500 | 4 | 0.07 | 14 | 120 | 5 | 10 | 15 |
| No. 35 | 414 | 60000 | 100 | 2 | 0.1 | 14 | 108 | 10 | 8 | 18 |

TABLE 3

(Others)

| Test | Water pressure | | Rotation | Speed | Cut | Roughness | | Number of protrusions | | |
|---|---|---|---|---|---|---|---|---|---|---|
| No. | MPa | Psi | rpm | mm/sec | mm | Ra | Rz | No. 1 | No. 2 | Total |
| No. 36 | 414 | 60000 | 200 | 2 | 0.22 | 15 | 100 | 6 | 4 | 10 |
| No. 37 | 414 | 60000 | 200 | 2 | 0.04 | 5 | 51 | 0 | 0 | 0 |
| No. 38 | 414 | 60000 | 200 | 2 | 0 | 2.5 | 48 | 0 | 0 | 0 |
| No. 39 | 414 | 60000 | 200 | 2 | 0 | 2.4 | 47 | 0 | 0 | 0 |

Table 4 shows the center-line average roughness (Ra) and the ten-point average roughness (Rz) of the outer peripheral wall surfaces of the cylinder liners of No. 16 to No. 39, and the number of key-shaped small protrusions on the outer peripheral wall surfaces which were measured before the high-pressure water jet. In Table 4, the ten-point average roughness (Rz) and the center-line average roughness (Ra) are indicated in the unit of $\mu$m. In Table 4, the numbers of key-shaped small protrusions at two sites of measurement are shown in the columns of No. 1 and No. 2 of the number of protrusions.

TABLE 4

| | Roughness | | Number of protrusions | | |
|---|---|---|---|---|---|
| Test No. | Ra | Rz | No. 1 | No. 2 | Total |
| Nos. 16–35 | 11 | 98 | 0 | 0 | 0 |
| No. 36 | 9 | 78 | 0 | 0 | 0 |
| No. 37 | 2 | 50 | 0 | 0 | 0 |
| No. 38 | 2 | 50 | 0 | 0 | 0 |
| No. 39 | 1.8 | 48 | 0 | 0 | 0 |

In all the cylinder liners (No. 18 to No. 35) produced from a flake graphite cast iron by centrifugal casting, the number of key-shaped small protrusions was greater than 10. Therefore, it is considered preferable that a cylinder liner be produced from a flake graphite cast iron by centrifugal casting, in view of increasing the number of key-shaped small protrusions so as to improve the adhesion strength. In the cylinder liner (No. 36) produced from a flake graphite cast iron by gravity casting, the number of key-shaped small protrusions was 10.

In contrast to the cylinder liners (No. 18 to No. 35 and No. 36) produced from flake graphite cast iron, the cylinder liners (No. 37 to No. 39) produced from other materials, that is, a spheroidal graphite cast iron, a carbon steel (JIS G 4051 S45C), and a heat resisting steel bar (JIS G 4311 SUS304) acquired no key-shaped small protrusions in the high-pressure water jet conditions indicated above in conjunction with Measurement 2.

The amounts of cut of the cylinder liners (No. 18 to No. 35 and No. 36) produced from flake graphite cast iron were at least 0.07 mm. In contrast, the amount of cut of the cylinder liner produced from a spheroidal graphite cast iron was 0.04 mm. The amounts of cut of the cylinder liner (No. 38) produced from a carbon steel (JIS G 4051 S45C) and the cylinder liner (No. 39) produced from a heat resisting steel bar (JIS G 4311 SUS304) were 0 mm. It has been found that the high-pressure water jet conditions indicated in conjunction with Measurement 2 achieved substantially no cutting, in addition to failing to produce key-shaped small protrusions in a satisfactory manner.

Comparison of the surface roughness of the cylinder liners (No. 37 to No. 39) formed from materials other than the flake graphite cast iron with the surface roughness thereof occurring before the high-pressure water jet indicates a phenomenon in which the high-pressure water jet reduces the surface roughness.

A conceivable reason why the use of flake graphite cast iron allows the cutting of surfaces and the formation of key-shaped small protrusions is that cracks form at boundaries between contiguously linked flake graphite portions and base structure or inside the contiguously linked graphite portions so that the base structure partially falls off along cracks. A reason why the use of flake graphite cast iron in centrifugal casting particularly facilitates formation of key-shaped small protrusions is considered as follows. That is, as a result of the rapid cooling of near-surface portions of a centrifugal-cast product, the near-surface portions contain large amounts of pearlite and D-type graphite. Due to the impacts of high-pressure water, the D-type graphite and surrounding base structure fall off, so that key-shaped small protrusions made mainly of pearlite are formed.

[3] Execution of Erosion-wash Step: Measurement of Sand, Mold Release Agent, Etc.

(1) In cylinder liners produced by centrifugal casting, sand (silica sand $SiO_2$) used for the lining of an inner surface of the mold and the mold release agent remain in dip portions of the asperities of the outer peripheral wall surface. In the process of cast-enclosing such a cylinder liner with an aluminum alloy or the like, the sand and the mold release agent remaining on the outer peripheral wall surface of the cylinder liner impede entrance of the melt of aluminum alloy or the like into dip portions of the outer peripheral wall surface, or incur poor adhesion of the aluminum alloy or the like, thus causing reduced strength of adhesion between the cylinder liner and the cylinder block body.

(2) Removal of Sand and Mold Release Agent by Shot Blast Process

In the conventional art, the shot blast process is performed on the outer peripheral wall surface of a cylinder liner to remove sand and the mold release agent from the outer peripheral wall surface. However, this process is not sufficiently successful.

Figure 27:
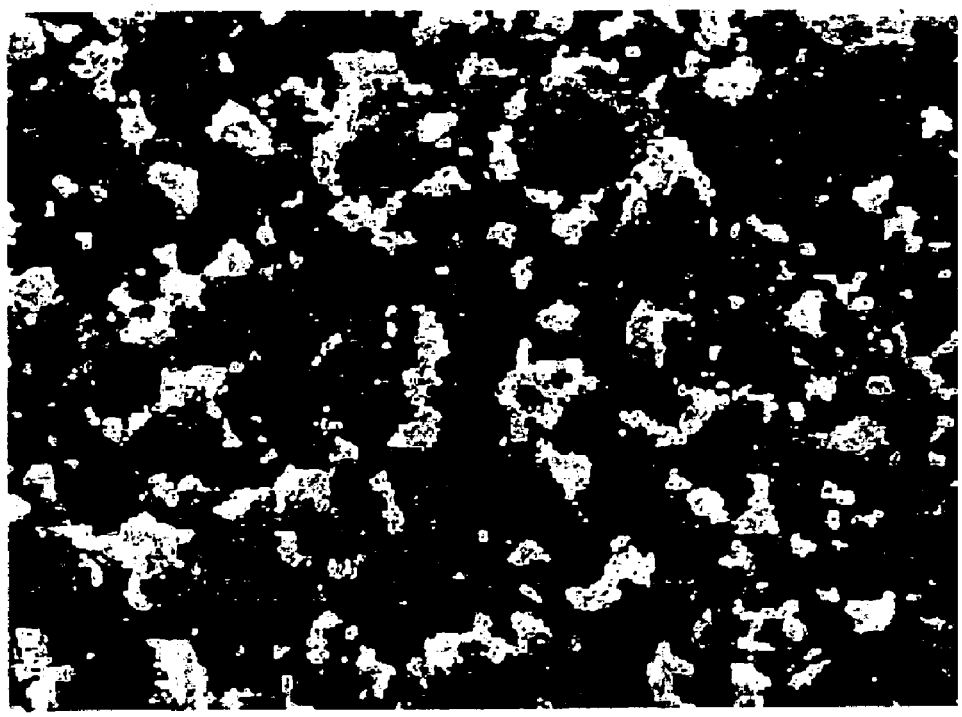
FIG. 27 shows a scanning electron microscope (SEM) photograph of the outer peripheral wall surface of a cylinder liner subjected to the shot blast process.

FIG. 27 shows a scanning electron microscope (SEM) photograph of the outer peripheral wall surface of a cylinder liner subjected to the shot blast process. The shot blast process herein was performed using alumina particles (#24) as a grid in the condition that the amount of grid projection was 135 g/min., and the grid speed was 60 m/sec., and the processing time was 0.07 sec./$cm^2$. As for the shape of the cylinder liner, the inside diameter thereof was 79 mm, and the outside diameter thereof was 89 mm, and the length thereof was 136 mm.

In FIG. 27, the whitish spots indicate residual mold release agent on the outer peripheral wall surface of the cylinder liner. Thus, it can be seen that after the shot blast process, the mold release agent remains on the outer peripheral wall surface of the cylinder liner as shown in FIG. 27. It is expected that further application of stronger shot blast will only crush protrusions on the cylinder liner outer peripheral wall surface, and will fail to remove the mold release agent stuck deep in dip portions.

(3) Removal of Sand and Mold Release Agent by Erosion-Wash Step

Therefore, an identical cylinder liner was subjected to the erosion-wash step performed by high-pressure water jet described above in conjunction with the embodiment. As for the conditions of high-pressure water jet, the nozzle diameter was 0.38 mm (0.015 inch), and the water pressure was 310 MPa (45000 Psi), the nozzle moving speed was 2 mm/sec., and the cylinder liner rotation speed was 200 rpm, and the distance from the high-pressure water outlet of the nozzle to the outer peripheral wall surface of the cylinder liner was 12.5 mm. The nozzle used was a fan-jet nozzle that caused atomization of high-pressure water at a distance of 10 mm from the high-pressure water outlet (outlet orifice).

Figure 28:
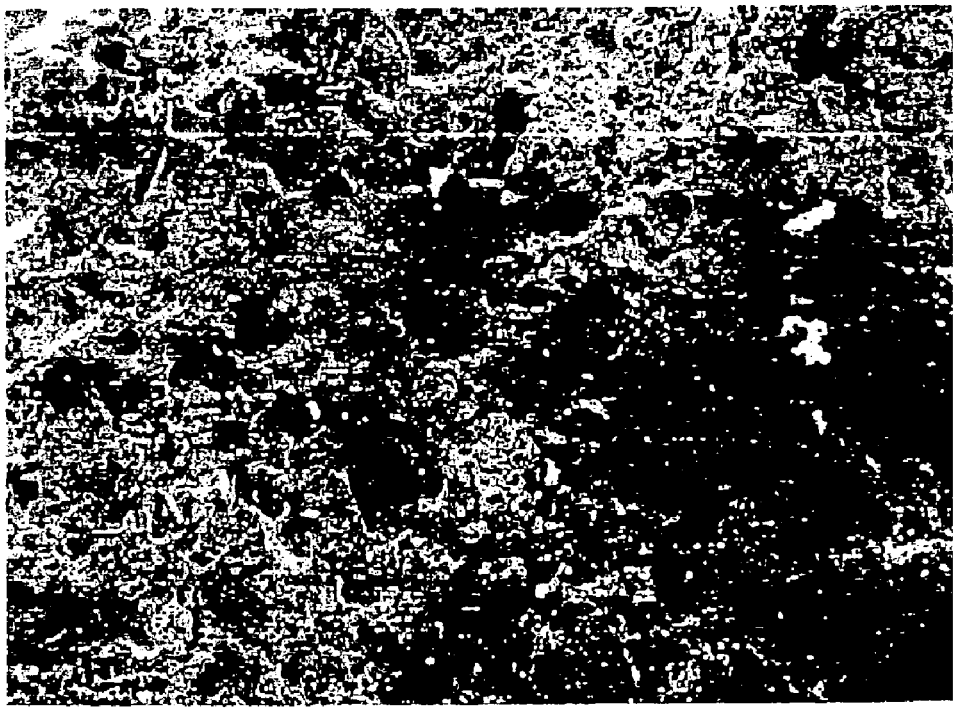
FIG. 28 shows a photograph of the outer peripheral wall surface of the cylinder liner taken by a scanning electron microscope (SEM) after the erosion-wash step.

In the aforementioned conditions, the high-pressure water jet was performed on the outer peripheral wall surface of the cylinder liner. FIG. 28 shows a photograph of the outer peripheral wall surface of the cylinder liner taken by a scanning electron microscope (SEM) after the high-pressure water jet was performed in the aforementioned conditions. The view of the outer peripheral wall surface shown in FIG. 28 indicates substantially complete removal of sand from the outer peripheral wall surface.

Therefore, cylinder liners of flake graphite cast iron produced by centrifugal casting were subjected to high-pressure water jet with varied water pressures, and the proportion of the area of sand remaining on the outer peripheral wall surface to the outer peripheral wall surface of each cylinder liner was measured.

As for conditions of high-pressure water jet, the nozzle diameter was 0.38 mm, and the cylinder liner rotation speed was set at 200 rpm, and the distance from the high-pressure water outlet of the nozzle to the cylinder liner outer peripheral wall surface was set at 12.5 mm. The nozzle used was a fan-jet nozzle that caused atomization of high-pressure water at a distance of 10 mm from the high-pressure water outlet (outlet orifice). The nozzle moving speed was set at three values, that is, 2 mm/sec., 4 mm/sec. and 6 mm/sec. The water pressure of high-pressure water jet was variably set at 207 MPa, 241 MPa, 276 MPa, 310 MPa, 345 MPa, 379 MPa and 414 MPa.

Figure 29:
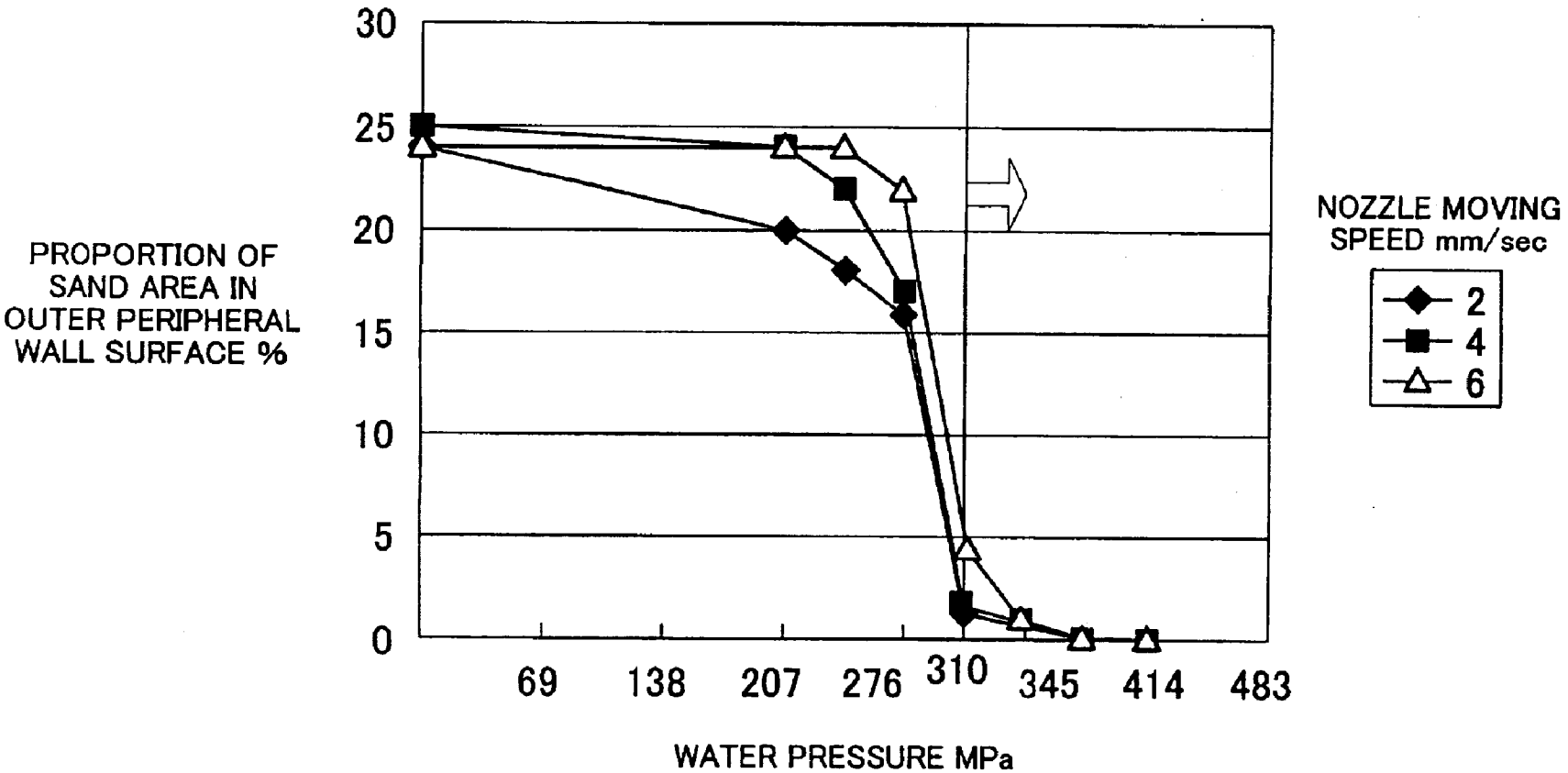
FIG. 29 is a graph indicating a relationship between the water pressure of high-pressure water jet and the proportion of sand area in the outer peripheral wall surface.
Figure 30:
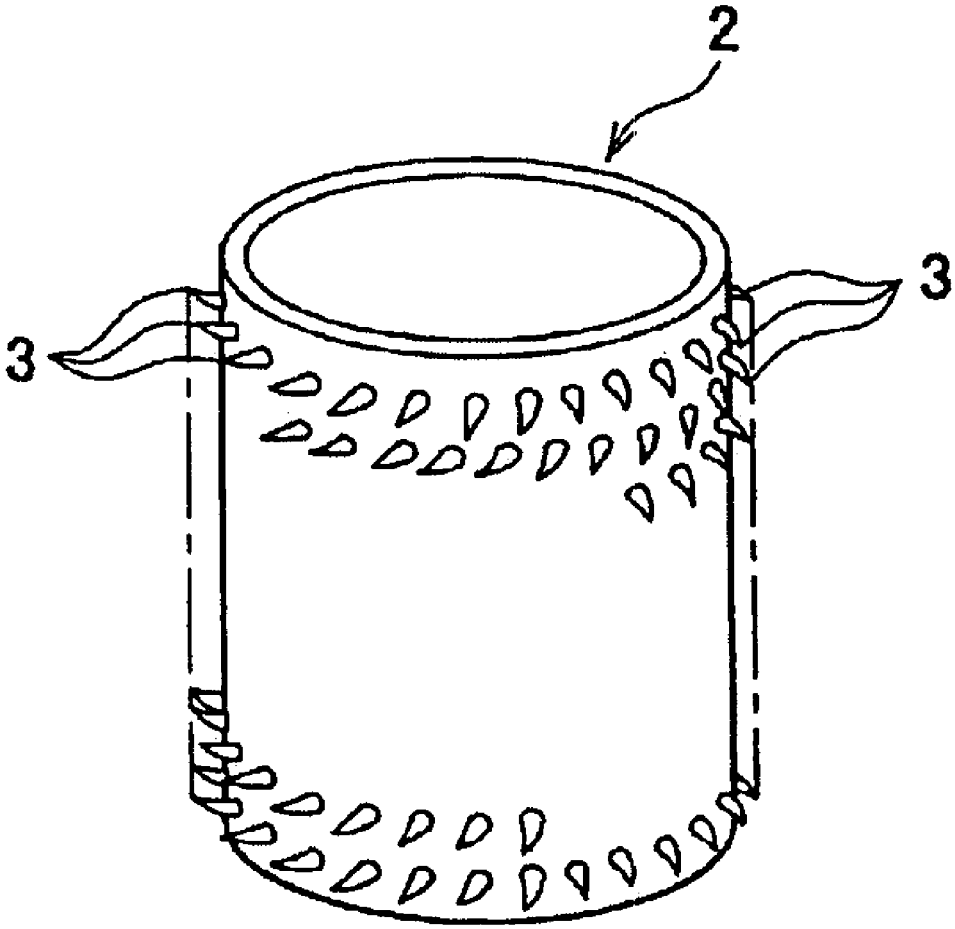
F I G. 30 PRIOR ART
FIG. 30 is a perspective view of an embodiment of a cylinder liner disclosed in Japanese Patent Application Laid-Open Publication No. JP-A-58-211550.

Results of the measurement are indicated in FIG. 29. It can be seen from FIG. 29 that in the case of high-pressure jet under the aforementioned conditions, the sand area proportion sharply dropped at a water pressure of 310 MPa. Therefore, it can be understood that if the nozzle diameter is about 0.38 mm, execution of high-pressure water jet at a water pressure of about 310 MPa or higher is preferable in view of removal of sand and the mold release agent.

Consequently, it is now apparent that execution of the erosion-wash step in the cylinder block production method of the invention accomplishes not only the formation of small protrusions, including key-shaped small protrusions, on the outer peripheral wall surface of a cylinder liner, but also the removal of the sand and the mold release agent adhering to the outer peripheral wall surface.

While the invention has been described with reference to what are presently considered to be preferred embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the invention.

What is claimed is:

1. A cylinder block production method for producing a cylinder block in which a cast iron-made cylinder liner is enclosed within a cylinder block body by casting, comprising:

a cast-enclosing step of enclosing the cylinder liner within the cylinder block body by casting, the cylinder block body comprising one of the group consisting of aluminum and an aluminum alloy, and the cylinder liner comprising flake graphite cast-iron; and washing an outer peripheral wall surface of the cylinder liner and eroding a portion of a base structure of the cast iron forming the outer peripheral wall surface of the cylinder liner so as to form many small protrusions on the outer peripheral wall surface, including a key-shaped small protrusion, by fan-jetting a high-pressure fluid onto the outer peripheral wall surface of the cylinder liner, prior to the cast-enclosing step in order to improve strength of adhesion between the cylinder liner and the cylinder block body;

wherein a flow rate of the high pressure fluid is 2.67 to 10 L/min, and wherein a pressure of the high pressure fluid is 276 to 414 MPa.

2. The production method according to claim 1, wherein the high-pressure fluid is water.

3. The production method according to claim 1, wherein the fan jet is a straight fan.

4. The production method according to claim 1, wherein the graphite is an A-type graphite.

5. The production method according to claim 1, wherein the graphite is a D-type graphite.

* * * * *